US010993884B2

(12) United States Patent
Dunn et al.

(10) Patent No.: US 10,993,884 B2
(45) Date of Patent: May 4, 2021

(54) SYSTEM FOR VENTING, PRIMING AND MODIFYING A FLOW RATE OF FLUID FROM A CONTAINER

(71) Applicants: Steven Bryan Dunn, Beverly Hills, CA (US); Kevin Douglas Johnson, Tarzana, CA (US); Nairi Khachikian, Glendale, CA (US)

(72) Inventors: Steven Bryan Dunn, Beverly Hills, CA (US); Kevin Douglas Johnson, Tarzana, CA (US); Nairi Khachikian, Glendale, CA (US)

(73) Assignee: Munchkin, Inc., Van Nuys, CA (US)

( * ) Notice: Subject to any disclaimer, the term of this patent is extended or adjusted under 35 U.S.C. 154(b) by 304 days.

(21) Appl. No.: 13/692,760

(22) Filed: Dec. 3, 2012

(65) Prior Publication Data

US 2013/0140260 A1 Jun. 6, 2013

Related U.S. Application Data

(60) Provisional application No. 61/647,341, filed on May 15, 2012, provisional application No. 61/565,972, filed on Dec. 1, 2011.

(51) Int. Cl.

| | |
|---|---|
| ***A61J 9/00*** | (2006.01) |
| ***A61J 9/04*** | (2006.01) |
| ***A61J 11/00*** | (2006.01) |

(52) U.S. Cl.

CPC . *A61J 9/00* (2013.01); *A61J 9/04* (2013.01); *A61J 11/006* (2013.01); *A61J 11/008* (2013.01)

(58) Field of Classification Search

CPC . A61J 9/00; A61J 11/008; A61J 11/006; A61J 9/04

USPC ..... 215/11.1–11.6, 274, 276, 277, 381; 220/360; D24/195–198

See application file for complete search history.

(56) References Cited

U.S. PATENT DOCUMENTS

| | | | | | |
|---|---|---|---|---|---|
| 362,554 | A | * | 5/1887 | Suydam | 215/11.5 |
| 533,726 | A | * | 2/1895 | McBride | 215/11.5 |
| 921,387 | A | * | 5/1909 | Etter | 215/11.5 |
| 1,732,126 | A | * | 10/1929 | Gardner | 215/11.5 |
| 1,938,052 | A | * | 12/1933 | Speir | 215/11.5 |

(Continued)

FOREIGN PATENT DOCUMENTS

| | | | | | |
|---|---|---|---|---|---|
| JP | 03012163 | A | * | 1/1991 | A61J 11/00 |

OTHER PUBLICATIONS

International Searching Report and Written Opinion for PCT/US2012/067634 dated Apr. 5, 2013 (pp. 1-12).

(Continued)

*Primary Examiner* — Ernesto A Grano

(74) *Attorney, Agent, or Firm* — Alan D. Borelli; Robert Z. Evora, Esq.

(57) ABSTRACT

An expandable container system including a container, an expandable nipple and a one-way valve. The expandable nipple is attached to the first end of the container and the valve is attached to a second end of the container. A counteracting bias force is generated within the container and a first fluid is drawn in through the valve by extending the expandable nipple. When the expandable nipple is released, the expandable nipple is biased back to an unextended state, and an increase in pressure created by the counteracting bias force induces a second fluid to flow out of an outlet in the expandable nipple.

20 Claims, 16 Drawing Sheets

(56) References Cited

U.S. PATENT DOCUMENTS 2,043,186 A * 6/1936 O'Dette ..... 215/11.5
2,084,099 A * 6/1937 MacCoy ..... 137/43
2,090,749 A * 8/1937 Corsi et al. ..... 215/11.2
2,394,722 A * 2/1946 Sloane ..... A61J 9/04 215/11.5
2,669,234 A * 2/1954 Baracate ..... 215/11.4
2,753,068 A * 7/1956 Robinson ..... 215/11.4
2,825,479 A * 3/1958 Litzie ..... 215/11.5
2,907,485 A * 10/1959 Lunden ..... 215/11.1
2,987,209 A * 6/1961 Royal ..... 215/11.3
3,134,494 A * 5/1964 Quinn ..... 215/11.3
3,651,973 A * 3/1972 Yamauchi ..... 215/11.3
3,768,682 A * 10/1973 Meyers et al. ..... 215/11.5
3,768,683 A * 10/1973 Van Den Bosch ..... 215/11.5
4,311,245 A * 1/1982 Maffei ..... A61J 9/04 215/11.5
4,339,046 A * 7/1982 Coen ..... 215/11.5
4,401,224 A * 8/1983 Alonso ..... 215/11.5
4,524,805 A * 6/1985 Hoffman ..... F16K 15/147 137/846
4,545,491 A * 10/1985 Bisgaard et al. ..... 215/11.5
4,685,577 A * 8/1987 Chen ..... 215/11.5
4,723,668 A * 2/1988 Cheng ..... 215/11.5
4,730,744 A * 3/1988 Vinciguerra ..... 215/11.5
4,759,139 A * 7/1988 Ricks ..... 40/638
4,760,937 A * 8/1988 Evezich ..... 222/95
4,821,896 A * 4/1989 Cheng ..... 215/11.3
4,865,207 A * 9/1989 Joyner et al. ..... 215/11.5
4,909,416 A * 3/1990 Evezich ..... 222/95
4,928,836 A * 5/1990 Wu ..... A61J 9/04 137/542
5,156,300 A * 10/1992 Spahni ..... B05B 11/048 222/105
5,301,707 A * 4/1994 Hofsteenge ..... F16K 15/147 137/12
5,431,290 A * 7/1995 Vinciguerra ..... A61J 9/04 137/845
5,433,353 A * 7/1995 Flinn ..... 222/481
5,472,112 A * 12/1995 Maciejewski ..... 220/745
5,487,490 A * 1/1996 Estes ..... B65D 47/2031 222/1
5,499,729 A * 3/1996 Greenwood et al. ..... 215/11.5
5,551,583 A * 9/1996 Sachathamakul et al. ... 215/386
5,607,074 A * 3/1997 De Gennaro ..... 215/11.5
5,669,520 A * 9/1997 Simpson ..... A61J 9/00 215/11.1
D384,748 S * 10/1997 Dunn ..... D24/196
5,692,627 A * 12/1997 Feng ..... 215/11.5
5,699,921 A * 12/1997 Rodriguez ..... A61J 9/04 215/11.5
5,747,083 A * 5/1998 Raymond et al. ..... 426/117
5,799,808 A * 9/1998 Oh ..... 215/11.1
5,938,053 A 8/1999 Verbovszky et al.
5,993,479 A * 11/1999 Prentiss ..... 606/236
6,053,342 A * 4/2000 Chomik ..... 215/11.5
6,073,788 A * 6/2000 Stroud ..... 215/11.1
6,073,812 A * 6/2000 Wade ..... A47K 5/1215 137/68.11
6,092,551 A * 7/2000 Bennett ..... F16K 15/147 137/843
6,092,680 A * 7/2000 Pillado ..... 215/11.1
D441,087 S * 4/2001 Johansen et al. ..... D24/197
6,209,736 B1 * 4/2001 Chen ..... A61J 9/04 215/11.1
6,253,935 B1 * 7/2001 Fletcher ..... 215/11.1
D463,567 S * 9/2002 Morano ..... D24/196
6,446,822 B1 * 9/2002 Meyers et al. ..... 215/11.5
D464,434 S * 10/2002 Morano ..... D24/197
6,601,720 B2 * 8/2003 Meyers et al. ..... 215/11.5
D486,579 S * 2/2004 Dunn ..... D24/196
D488,560 S * 4/2004 Renz et al. ..... D24/196
6,742,665 B2 * 6/2004 Lombardo ..... 215/11.5
6,779,694 B2 * 8/2004 Young ..... B65D 47/243 215/307
D511,385 S * 11/2005 Lieberman et al. ..... D24/197
6,971,551 B2 * 12/2005 Widgery ..... 222/129
7,326,234 B2 * 2/2008 Lieberman et al. ..... 606/236
7,331,478 B2 * 2/2008 Aljadi ..... 215/11.4
D580,066 S * 11/2008 Tilbury ..... D24/197
D590,950 S * 4/2009 Driver et al. ..... D24/197
D595,417 S * 6/2009 Driver et al. ..... D24/197
D599,481 S * 9/2009 Drummond ..... D24/197
D599,482 S * 9/2009 Drummond ..... D24/197
7,866,495 B2 * 1/2011 Rohrig ..... 215/11.5
8,016,142 B2 * 9/2011 Renz ..... 215/11.5
8,181,800 B2 * 5/2012 Rees et al. ..... 215/11.5
8,397,926 B2 * 3/2013 Driver et al. ..... 215/11.3
D684,267 S * 6/2013 Smith ..... D24/196
8,561,851 B1 * 10/2013 Leonoff ..... B65D 47/243 137/847
8,567,619 B2 * 10/2013 Renz ..... 215/11.5
8,596,478 B2 * 12/2013 Gadzic ..... B65D 47/265 141/320
8,636,158 B2 * 1/2014 Frisch ..... 215/11.1
8,875,913 B2 * 11/2014 Diaz ..... A61J 9/005 215/11.1
D739,539 S * 9/2015 Khachikian ..... D24/195
2003/0024895 A1 * 2/2003 Meyers et al. ..... 215/11.5
2005/0035078 A1 * 2/2005 Lieberman et al. ..... 215/11.1
2005/0056611 A1 * 3/2005 Hakim ..... 215/11.6
2006/0265013 A1 * 11/2006 Holley, Jr. ..... 606/234
2007/0068890 A1 * 3/2007 Rohrig ..... 215/11.1
2007/0181520 A1 * 8/2007 Holley et al. ..... 215/11.1
2008/0078787 A1 4/2008 Yelland
2008/0087623 A1 4/2008 Grazioli
2008/0128379 A1 * 6/2008 Hen ..... 215/11.5
2008/0173612 A1 * 7/2008 Renz ..... 215/260
2008/0210655 A1 * 9/2008 Rees et al. ..... 215/11.5
2008/0314933 A1 * 12/2008 Leonoff ..... B65D 23/00 222/215
2009/0039049 A1 * 2/2009 Horntrich et al. ..... 215/11.6
2009/0139949 A1 * 6/2009 Py et al. ..... 215/11.1
2009/0139995 A1 * 6/2009 Py et al. ..... 220/703
2009/0178940 A1 * 7/2009 Said ..... 206/221
2010/0108719 A1 * 5/2010 Py ..... 222/257
2010/0140204 A1 6/2010 Vischer
2010/0193460 A1 * 8/2010 Driver et al. ..... 215/11.3
2010/0316774 A1 * 12/2010 Py et al. ..... 426/234
2011/0139079 A1 * 6/2011 Wadsworth ..... A01K 9/005 119/71
2011/0168714 A1 * 7/2011 Renz ..... 220/367.1
2011/0180508 A1 7/2011 Fong
2011/0297634 A1 * 12/2011 Diaz ..... A61J 9/00 215/11.4
2012/0037587 A1 * 2/2012 Tirosh ..... 215/11.5
2012/0175335 A1 * 7/2012 Itzek et al. ..... 215/11.1
2014/0263148 A1 * 9/2014 Diaz ..... A61J 9/005 215/11.3

OTHER PUBLICATIONS

International Preliminary Report and Written Opinion for PCT/US2012/067634, dated Jun. 12, 2014 (9 pages).

* cited by examiner

SYSTEM FOR VENTING, PRIMING AND MODIFYING A FLOW RATE OF FLUID FROM A CONTAINER

CROSS REFERENCE TO RELATED APPLICATIONS

This application claims priority to U.S. Provisional Patent Application Ser. No. 61/647,341, filed May 15, 2012; and to U.S. Provisional Patent Application Ser. No. 61/565,972, filed Dec. 1, 2011; the contents of which are hereby incorporated by reference herein in their entirety into this disclosure.

TECHNICAL FIELD

The subject disclosure relates to a system and method for venting, priming and modifying a flow rate of a fluid from a container. More particularly, the present disclosure relates to a container assembly having an expandable nipple and a one-way vent valve disposed therein to modify the flow rate of a fluid withdrawn from the container assembly.

BACKGROUND

Various types of valving mechanisms are known to vent air from within a bottle and to prevent the creation of an excess vacuum. Those typically known, include numerous component parts and are large, inconvenient and clumsy to assemble and disassemble. These large valving mechanisms may be integrated into the cap, via the spout and/or an air vent disposed near the cap.

Despite the ineffectiveness of these conventional valve mechanisms, a need exists for an efficient spill proof container assembly and method capable of simultaneously priming before and during use, while enabling a caregiver to efficiently moderating the flow of fluid through the nipple of a container.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
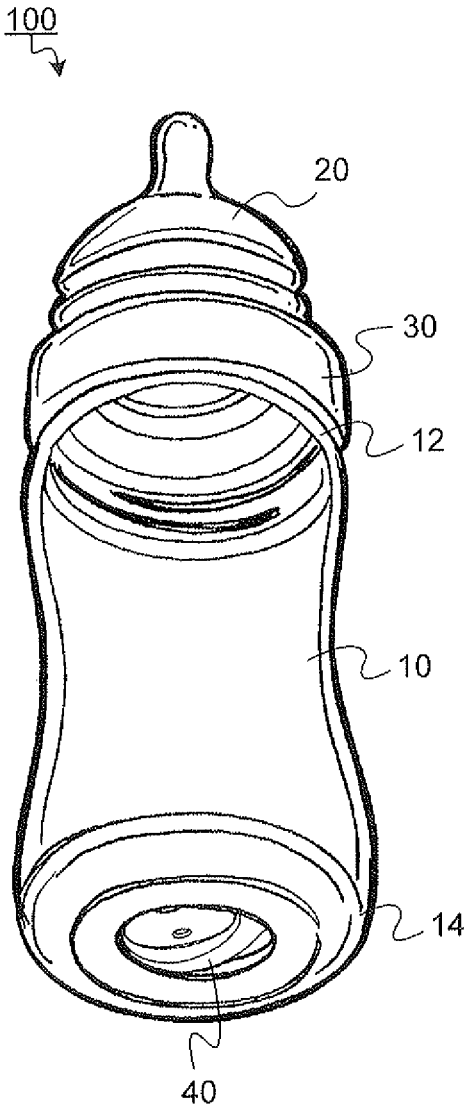
FIG. 1 illustrates an exploded exemplary container system including a cooperating expandable nipple and an air flow vent according to the subject disclosure.

FIG. 1 illustrates an exploded view of an exemplary container system 100. The container system 100 includes a container 10 having an expandable nipple 20 attached at a first end 12 by a collar 30. A one-way fluid flow valve 40 is disposed at a second end 14 of the container 10.

Figure 2:
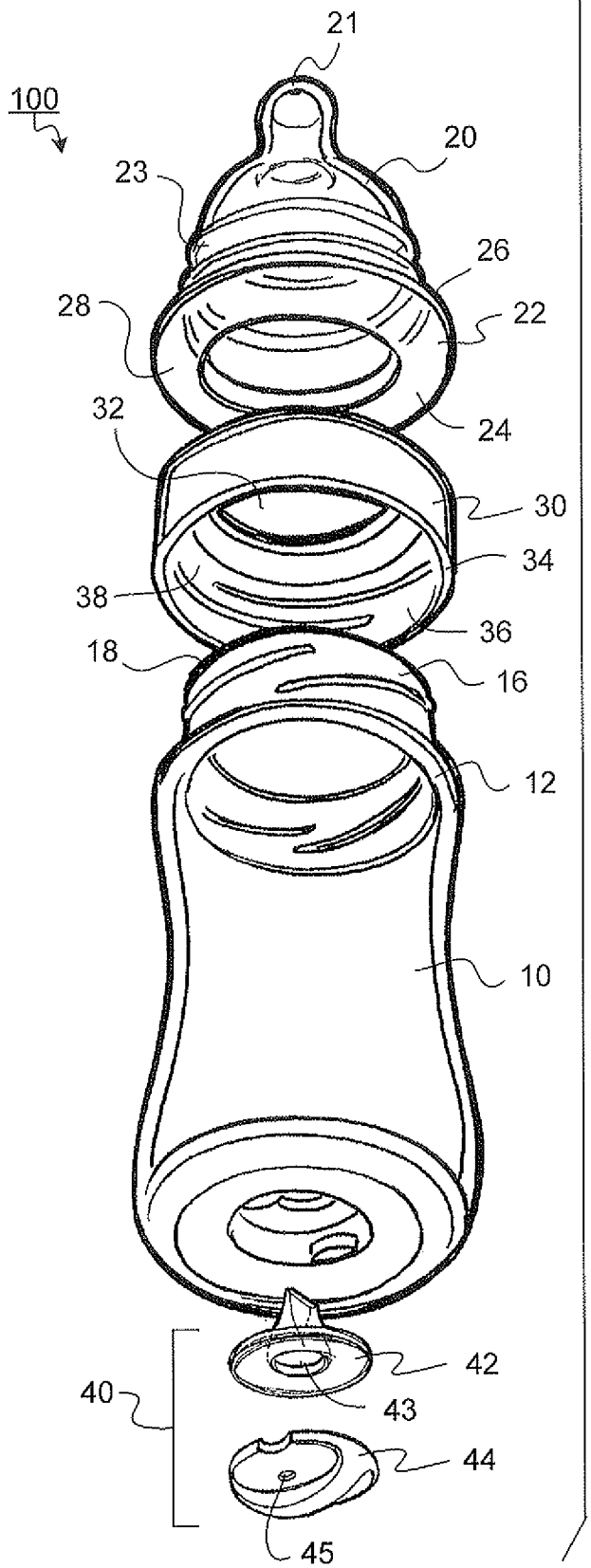
FIG. 2 shows the container system including a cooperating expandable nipple and an air flow vent.

FIG. 2 depicts an exploded perspective view of the container system 100. The container 10 includes a fastening means 16 adjacent to the first end 12. Although shown as a threaded fastener 16, 36 connection, it is to be understood that various fastening mechanisms may be employed for connecting the collar 30 to the first end 12 of the container 10.

The collar 30 includes a lower open end 34 connected adjacent to the first open end 12 of the container 10. A mating threaded fastener 36 is fastened to the threaded fastener 16 on the container 10. An aperture 32 is provided in an upper open end of the collar 30 adapted to receive a flange 22 of the expandable nipple 20.

The expandable nipple 20 includes an orifice 21 through which a fluid may flow. The expandable nipple 20 includes the flange 22 disposed at a lower end 24. An upper side 26 of the flange 22 is adapted to seat against a lower surface 38 of the collar 30. The lower side 28 of the flange 22 is adapted to seat against an upper surface 18 of the container 10. In a closed position, the flange 22 is constructed of a resilient sealing material adapted to provide a leak proof seal between the container 10, collar 30 and the expandable nipple 20.

Figure 3:
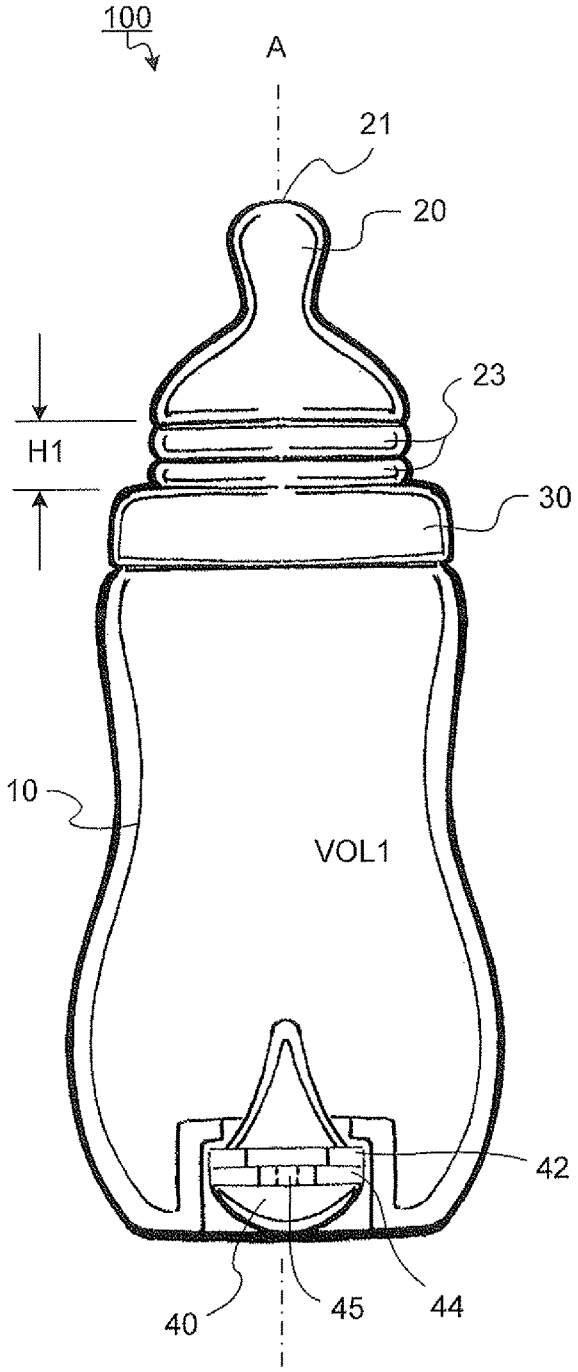
FIG. 3 depicts the nipple of the container system in an increased volumetric expanded position.

Referring to FIGS. 18-23, the expandable nipple 20 may be an accordion style nipple having at least one pleat or fold 23 with an interstitial space 25 disposed in the neck of the expandable nipple 20. The expandable nipple 20 provides various functions. First, the expandable nipple 20 is capable of increasing the volumetric area within the expandable container system 100 as will be described in more detail below. The expandable nipple 20 may be made of an elastic resilient material that is biased so that the pleats 23 and interstitial spaces 25 rest in an unextended configuration, such as shown in FIG. 3.

Figure 4:
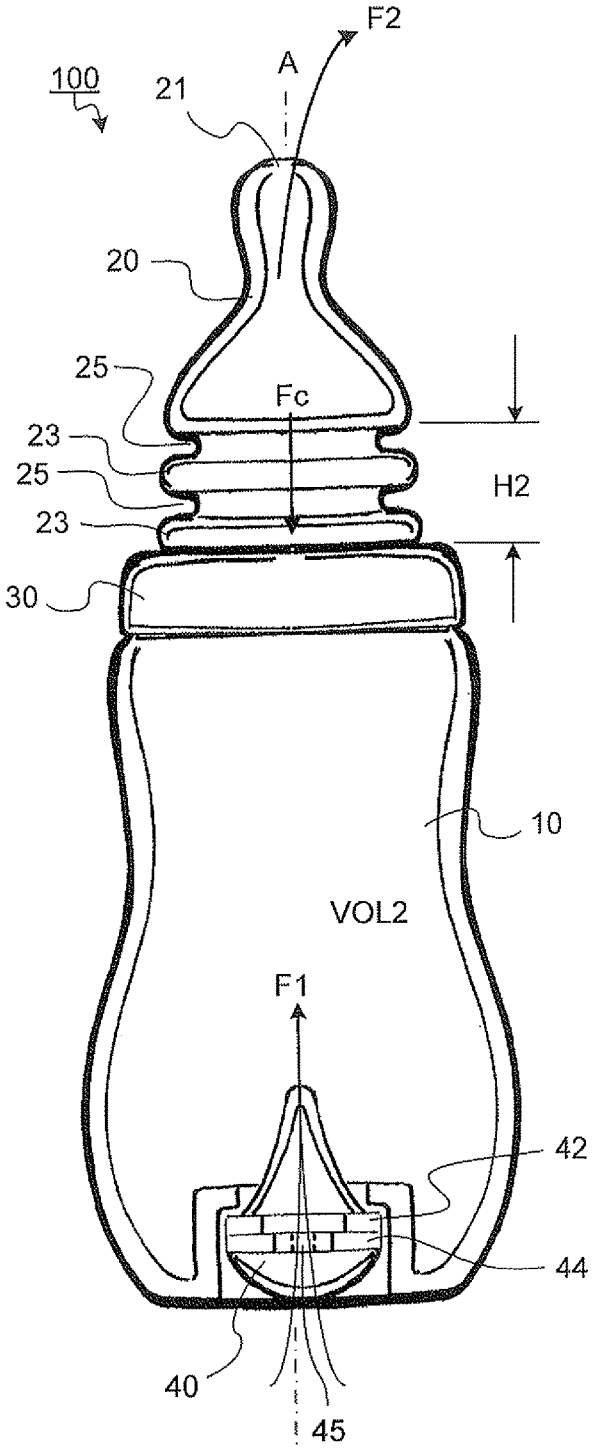
FIG. 4 depicts the nipple of the container system in a decreased volumetric unexpanded position.

Second, the expandable nipple 20 is elastically adapted to be flexibly stretched outward (as shown in FIG. 4) from the collar 30 and bend sideways at 360 degrees around an axial direction of the nipple extension. The axis (A) being substantially aligned with the length of the container system 100 as shown in FIGS. 3-4. The benefit of being able to extend and bend the expandable nipple 20 is realized when a nursing infant and/or animal that is sucking from the end of the expandable nipple 20 randomly tilts their head out of alignment with the axis (A) of the expandable nipple. As a result of the flexible movement by the end of the expandable nipple 20, the suckling latched onto the nipple will remain intact with the end of the nipple 20 as the tip of the nipple 20 is flexibly bent out of the axial alignment with the head of the nursing infant and/or animal.

This unique push and pull accordion style nipple 20 allows the infant to more readily self control the flow of milk (or other fluid) by sucking and or applying pressure (similar to breastfeeding) of the nipple 20. The flexibility of the nipple 20 helps the infant maintain a latch, even when the infant's head moves substantially out of alignment with the end of the container 10. Without the use of an expandable nipple 20, nursing infants and/or animal would likely detach from the nipple when a conventional un-expandable nipple was utilized.

Figure 21:
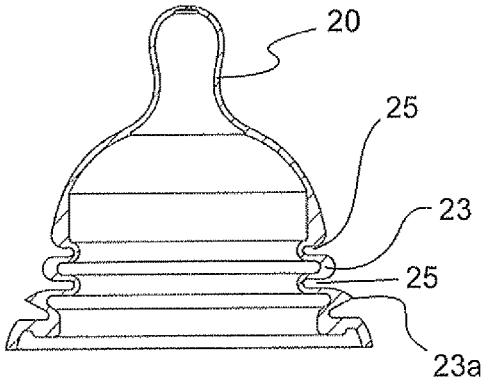
FIGS. 21, 22 and 23 depicts various views of another expandable nipple configuration for the container system.
Figure 19:
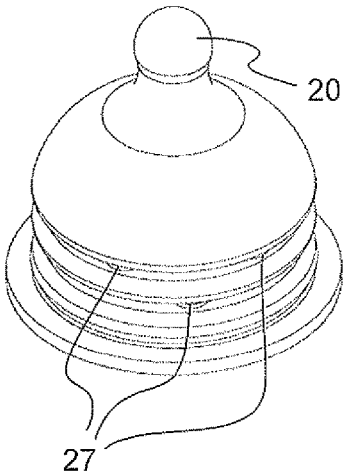
Figure 22:
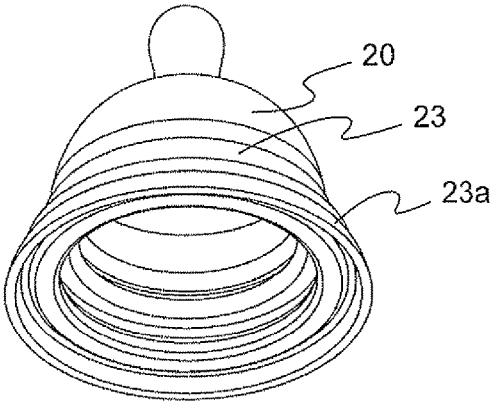
Figure 20:
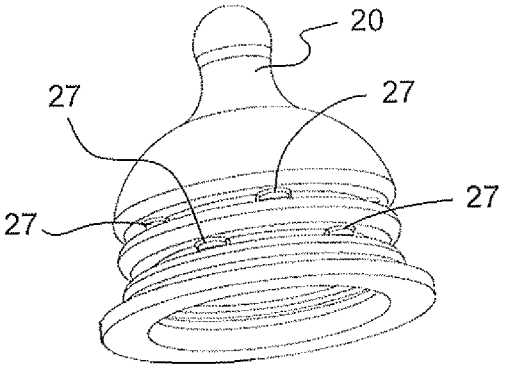
Figure 23:
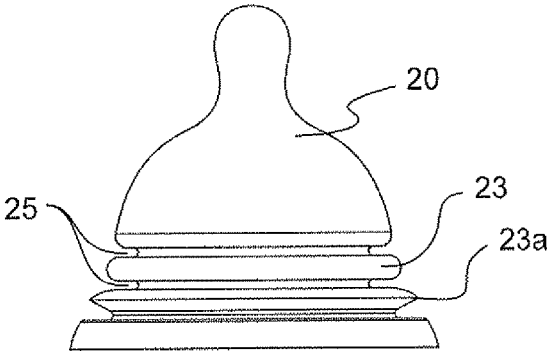

As shown in FIGS. 21-23, the expandable nipple 20 may be constructed to include a wider base nearest the collar 30 and a narrower top portion furthest away from the collar connection. The advantage of this configuration is to maximize the volume within the nipple 20 and the container 10 during use. The wider base in the expandable nipple 20 provides for extra volume. As shown in FIG. 21, the pleat closest to the collar 30 may be constructed as a tapered pleat 23*a*. Attached to the container 10 by the collar 30, the tapered pleat 23*a* is adapted to sit flush with the top edge of the collar 30 thereby enhancing the secure connection between the nipple 20 and the collar 30.

Referring back to FIGS. 2-4, the vent valve 40 includes a resilient member 42 and a cap 44. A first passage 43 is provided in the resilient member 42 to allow the flow of a first fluid (F1), such as atmospheric air. A second passage 45 is provided in the cap 44 to also allow the flow of the first fluid (F1) into and across the resilient member 42. The first passage 43 and the second passage 45 cooperate to efficiently allow the passage of a predetermined amount of the first fluid (F1) through the valve 40.

The size, shape, orientation of the valve, the resilient member and a variety other features are constructed to modulate the fluid flow rate of the first fluid (F1) across the valve 40. In a closed position, the resilient member 42 is constructed of an elastic resilient sealing material adapted to provide a leak proof seal between the container 10 and the cap 44. The cap 44 may be a rigid cap or the like capable of securing the resilient member 42 to the lower end of the container 10.

FIGS. 3 and 4 demonstrate an exemplary operation of the expandable container system 100. FIG. 3 shows the expandable container system 100 having a first volume (VOL1). As shown, the expandable container system 100 in FIG. 3 is in a position in which the internal pressure in the expandable container system 100 is in a steady state condition with the outer atmospheric pressure surrounding the expandable container system 100. As such, the first fluid (F1) (atmospheric air) outside of the container system 100 does not pass through the valve 40 disposed in the lower end of the expandable container system 100.

FIG. 4 shows the expandable container system 100 having a greater second volume (VOL2) than the first volume (VOL1) shown in FIG. 3. The expandable container system 100 is in a position in which the internal pressure within the expandable container system 100 has been reduced and has created a vacuum relative to the atmospheric pressure surrounding the expandable container system 100. As a result, the first fluid F1 (atmospheric air) is drawn in and passes through the valve 40 disposed in the lower end of the expandable container system 100 in an attempt to reestablish an equilibrium between the internal pressure and the atmospheric pressure surrounding the expandable container system 100. This condition can be caused when the expandable nipple 20 is pulled extended creating a vacuum within the container system 100 thereby drawing in the first fluid (F1) from outside of the valve 40.

In doing so, the volume (VOL2) of the expandable container system 100 increases from volume (VOL1) a predetermined amount greater than that shown in FIG. 3. That is, the expandable nipple 20 shown in FIG. 4 is expanded by a predetermined distance H2 beyond H1 (as shown in FIGS. 3-4) as the pleats 23 in the accordion neck portion of the expandable nipple 20 are extended. As a result, volume (VOL2) shown in FIG. 4 is increased by the interstitial gap portions 25 and the extension of the pleats 23 thereby creating a larger volume (VOL2) than the volume (VOL1) shown in FIG. 3. Likewise, the internal pressure in the expandable container system 100 shown in FIG. 4 is initially decreased such that the internal pressure in the container system 100 is less than the internal pressure of the expandable container system 100 shown in FIG. 3.

As mentioned previously, the expandable nipple 20 is made of a resilient material that is biased to rest in an unextended position such as shown in FIG. 3. Therefore, once a grip on the neck of the expandable nipple 20, by a user's hand or the like, has been released from an initial position shown in FIG. 4, a counteracting compression force (Fc) is produced by the extension in the pleats 23 and the interstitial gaps 25 in the elastic resilient material of the expandable nipple 20. That is, the counteracting force (Fc) produces a force biased to return the expandable nipple 20 from the stretched position shown in FIG. 4 to the compressed steady position shown in FIG. 3. The counteracting compression force (Fc) causes the expandable nipple 20 to compress the pleats 25 and interstitial gaps 25 back toward the steady state position shown in FIG. 3. As such, the counteracting compression force (Fc) compresses the enlarged volume (VOL2) within the expandable container system 100 so that a liquid disposed within the expandable container system 100 is biased to pour through the orifice passage 21 in the end of the expandable nipple 20.

This priming action produced in the expandable container system 100 is a coordinated effort between both, the expandable nipple 20 and the one-way valve 40 working simultaneously to initially build up an initial pressure in the expandable container system 100. Upon release of the extended expandable nipple 20, the counteracting compression force (Fc) is created that further increases the internal pressure in the enlarged volume (VOL2) so that the liquid within the expandable container system 100 is biased to pour out through the nipple passage orifice 21.

The construction of the expandable nipple and the vent valve may take various changes and/or modifications without departing from the broad inventive concepts of the subject disclosure.

Figure 5:
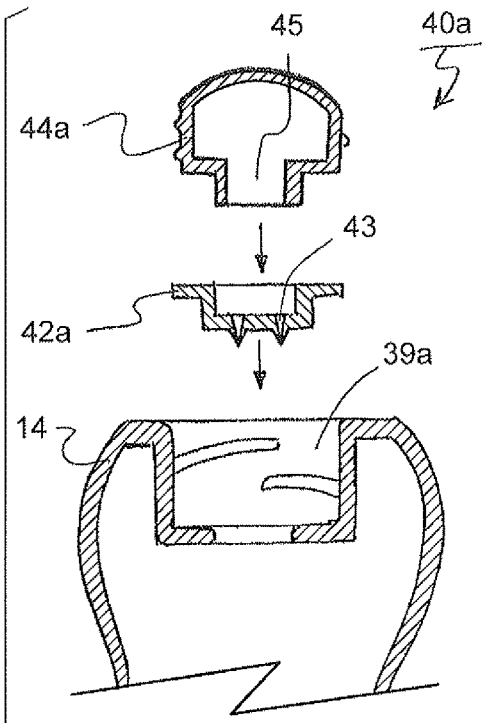
FIGS. 5 and 6 show exploded views of a first valve configuration for the container system, FIG. 5 being a cross section view about A-A in FIG. 6.
Figure 6:
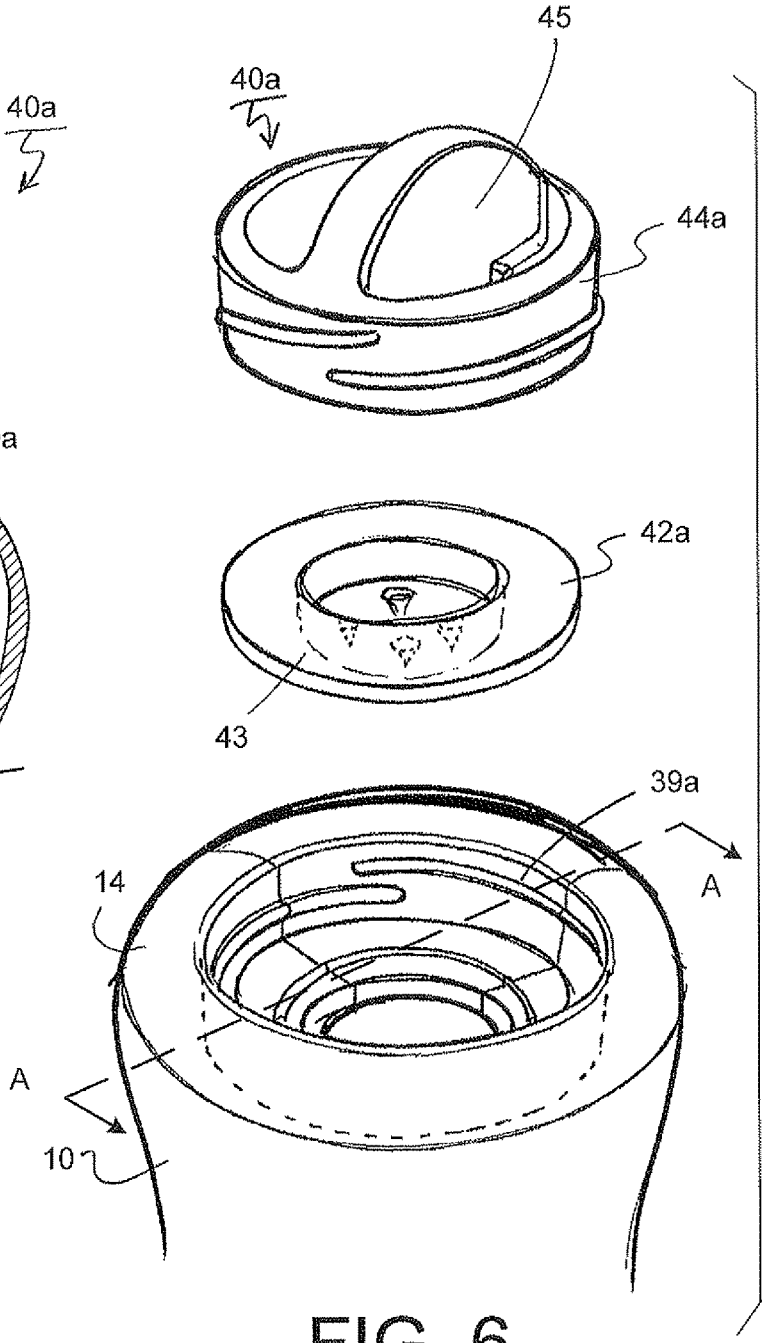

FIGS. 5 and 6 show exploded views of a first vent valve 40*a* configuration for the expandable container system 100. The vent valve 40*a* includes a resilient member 42*a* and a cap 44*a*. At least one passage 43 is provided in the resilient member 42*a* to allow the flow of the first fluid (F1). A second passage 45 is provided in the cap 44*a* to also allow the flow of the first fluid (F1). The first passage 43 and the second passage 45 cooperate to efficiently allow the passage of a predetermined amount of the first fluid (F1) through the valve 40*a* and into the container 10.

In a closed position, the resilient member 42*a* may be constructed in a circular recessed configuration and made of a resilient sealing material adapted to provide a leak proof seal between the container 10 and the cap 44*a*. The resilient member 42*a* is disposed between the cap 44*a* and the lower end 14 of the container 10. The cap 44*a* is threadedly fastened into a mating inwardly threaded portion 39*a* recessed in the lower end 14 of the container 10.

Figure 7:
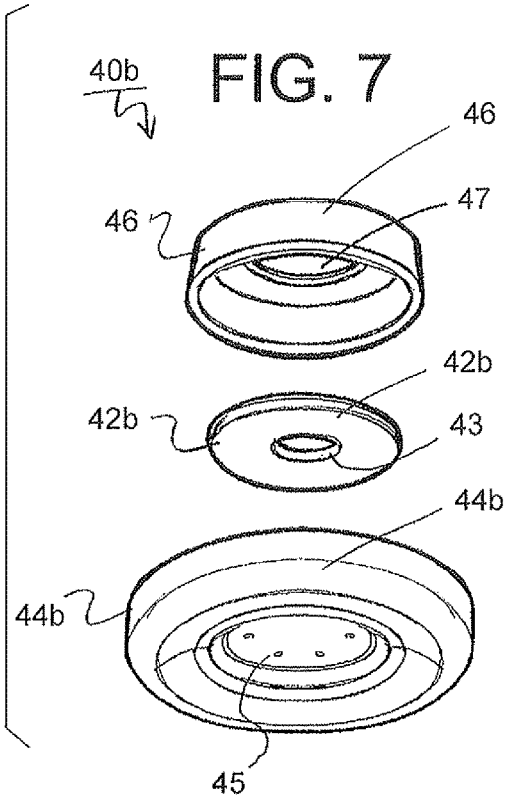
FIGS. 7, 8 and 9 illustrate exploded views of a second valve configuration for the container system, FIG. 8 being a cross section view about B-B in FIG. 9.
Figure 9:
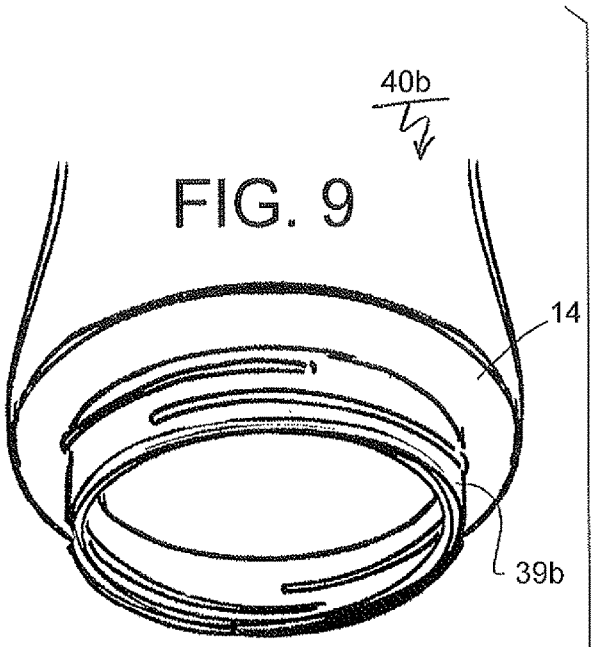
Figure 8:
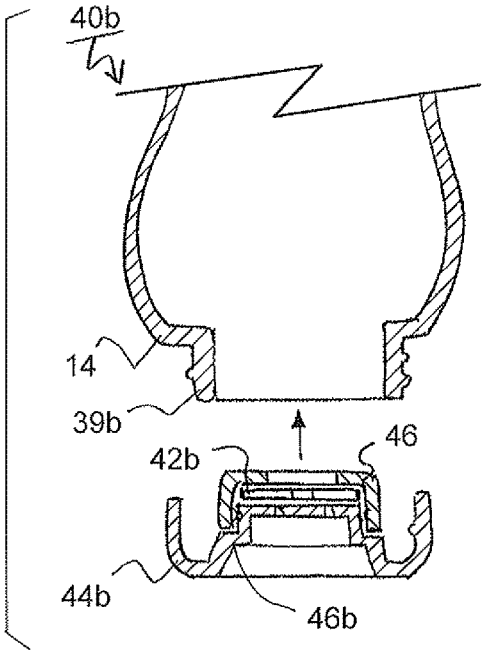
Figure 8:
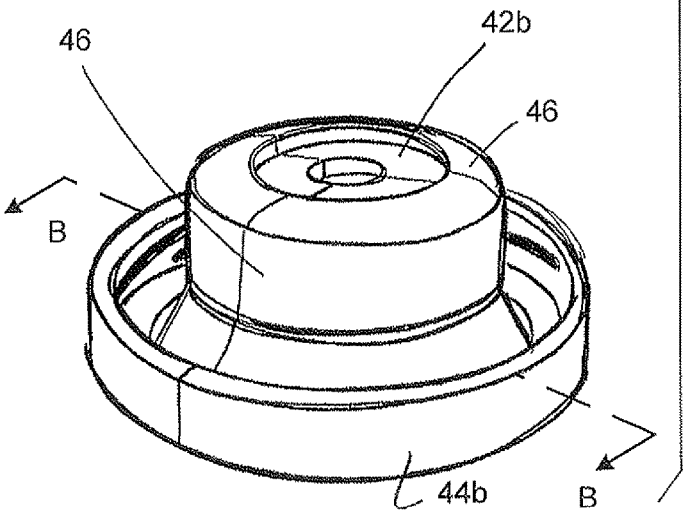

FIGS. 7, 8 and 9 show exploded views of a second vent valve 40*b* configuration for the expandable container system 100. The vent valve 40*b* includes a resilient member 42*b*, a cap 44*b* and a retainer 46. At least one passage 43 is provided in the resilient member 42*b* to allow the flow of a fluid. A second passage 45 is provided in the cap 44*b* to also allow the flow of the first fluid (F1). A third passage 47 is provided in the retainer 46 to also allow the flow of the first fluid (F1). The first passage 43, second passage 45 and third passage 47 cooperate to efficiently allow the passage of a predetermined amount of the fluid through the valve 40*b*.

In a closed position, the resilient member 42*b* is constructed in a flat circular configuration and made of a resilient sealing material adapted to provide a leak proof seal between the container 10, the retainer 46, and the cap 44*b*. The resilient member 42*b* is disposed between the cap 44*b* and the retainer 46 in the lower end 14 of the container 10. The retainer 46 may be snap locked onto the cap 44*b* via a detent fastener means 46*b* as shown in FIG. 8, or other mechanism for fastening the retainer 46 to the cap 44*b*. The cap 44*b* is threadedly fastened onto a mating outwardly threaded portion 39*b* disposed on an outer portion of the lower end 14 of the container 10.

In use, the second passages 45 are accessible from outside of the container 10. As constructed, the various vent holes in the passage 45 can be accessed and covered by a caregiver's finger unlike conventionally valving mechanisms before which could not perform this feature as described in the subject disclosure. That is, according to this subject disclosure, the caregiver can selectively block and unblock all of the vent passages 45 with a single finger.

Figure 10:
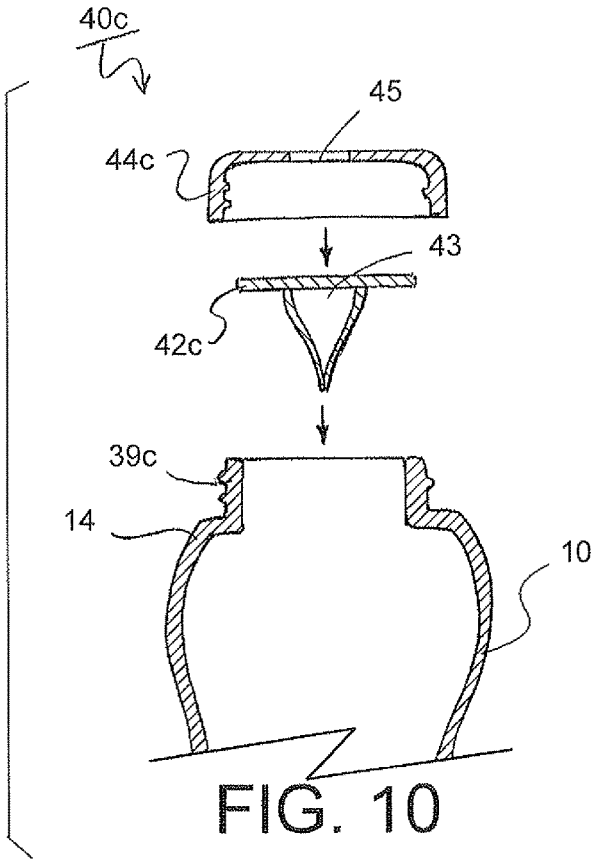
FIGS. 10 and 11 depict exploded views of a third valve configuration for the container system, FIG. 10 being a cross section view about C-C in FIG. 11.
Figure 11:
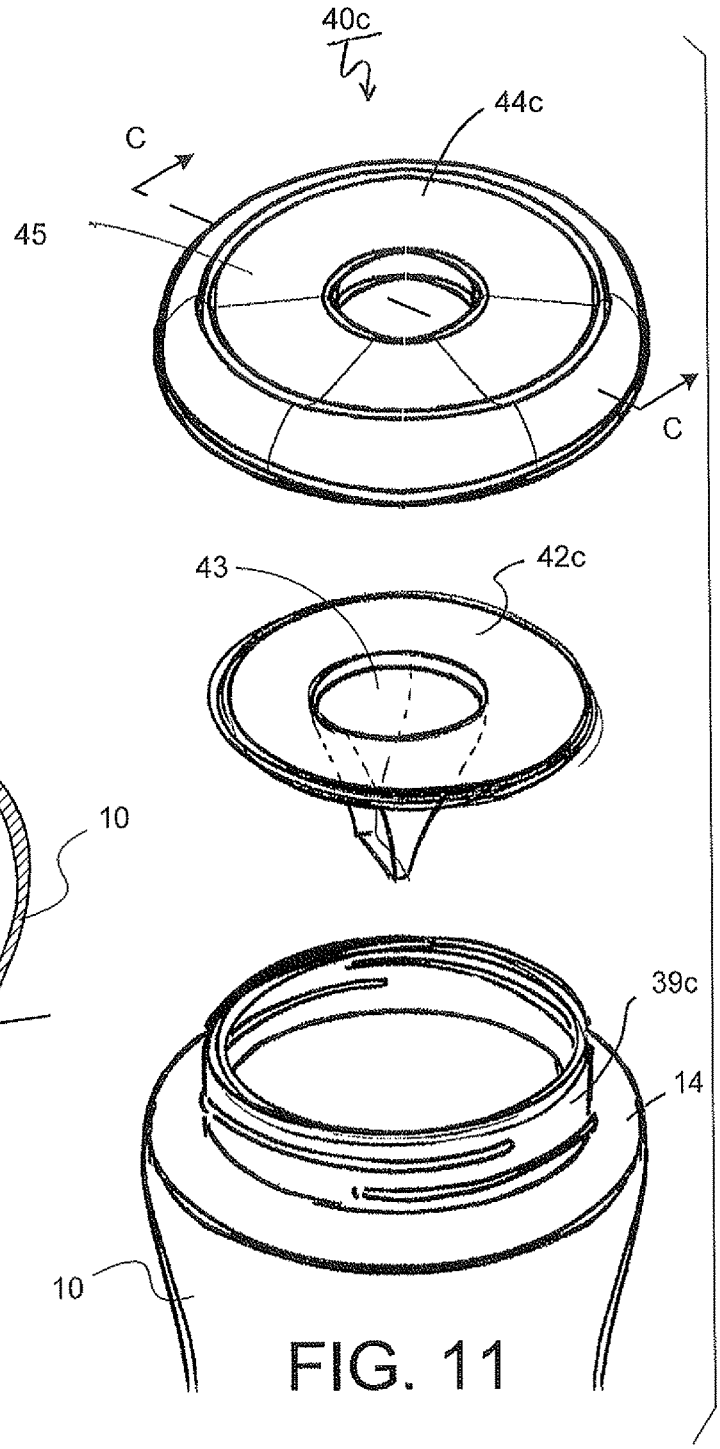

FIGS. 10 and 11 show exploded views of a third vent valve 40*c* configuration for the expandable container system 100. The vent valve 40*c* includes a resilient member 42*c* and a cap 44*c*. At least one passage 43 is provided in the resilient member 42*c* to allow the flow of a first fluid (F1). A second passage 45 is provided in the cap 44*c* to also allow the flow of the first fluid (F1). The first passage 43 and the second passage 45 cooperate to efficiently allow the passage of a predetermined amount of the first fluid (F1) through the valve 40*c*.

In a closed position, the resilient member 42*c* is constructed in a duck bill configuration and made of a resilient sealing material adapted to provide a leak proof seal between the container 10 and the cap 44*c*. The resilient member 42*c* is disposed between the cap 44*c* the lower end 14 of the container 10. The cap 44*c* may be threadedly fastened onto a mating outwardly threaded portion 39*c* disposed on an outer portion of the lower end 14 of the container 10.

Figure 12:
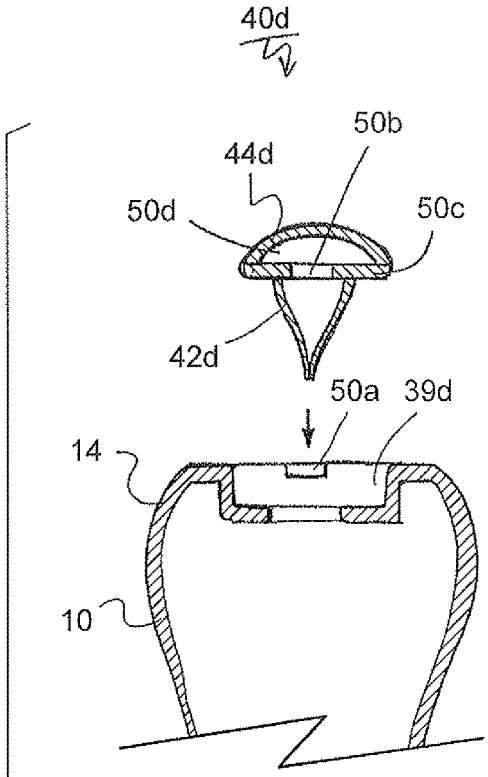
FIGS. 12 and 13 demonstrate exploded views of a fourth valve configuration for the container system, FIG. 12 being a cross section view about D-D in FIG. 13.
Figure 13:
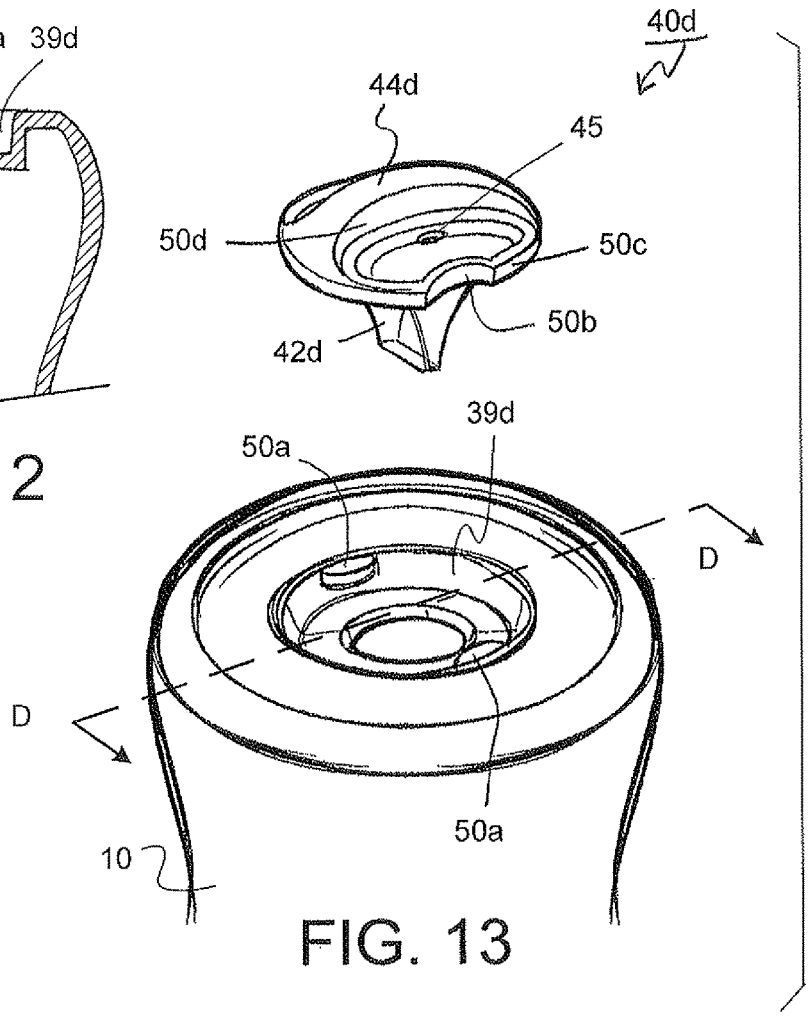

FIGS. 12 and 13 show exploded views of a fourth vent valve 40*d* configuration for the expandable container system 100. This vent valve 40*d* construction may be co-molded. The vent valve 40*d* includes a resilient member 42*d* and cap 44*d*. At least one passage 45 is provided in the co-molded vent valve 40*d* to allow the flow of a first fluid (F1). The passage 45 efficiently allows the passage of a predetermined amount of the first fluid (F1) through the co-molded vent valve 40*d*.

In a closed position, the co-molded vent valve 40*d* may be constructed with a duck bill configuration and partially made of a resilient sealing material adapted to provide a leak proof seal between the container 10 and the co-molded vent valve 40*d*. The co-molded vent valve 40*d* is disposed in a recess 39*d* disposed in the lower end 14 of the container 10. The co-molded vent valve 40*d* is secured into the recess 39*d* utilizing a pair of locking protrusions 50*a*.

The co-molded vent valve 40*d* includes a flange 50*c* and a cut-out portion 50*b* mating with the shape of the locking protrusions 50*a* in the recess 39*d* in the end of the container 10. In use, the co-molded vent valve 40*d* is aligned inside of the recess 39*d*, and the cut-out portion 50*b* on the flange 50*c* is aligned with the mating shape of the locking protrusions 50*a*. The upper surface of the flange 50*c* is depressed below the lower surface of the locking protrusions 50*a* and twisted by the knob 50*d* so that the cut-out portion 50*b* and the locking protrusions 50*a* are no longer aligned and the cap 44*d* is prevented from being withdrawn. That is, the flange 50*c* is then locked within the recess 39*d* disposed in the end 14 of the container 10 by the upper surface of the flange 50*c* bearing against the lower surface of the locking protrusions 50*a*.

Figures 14, 15:
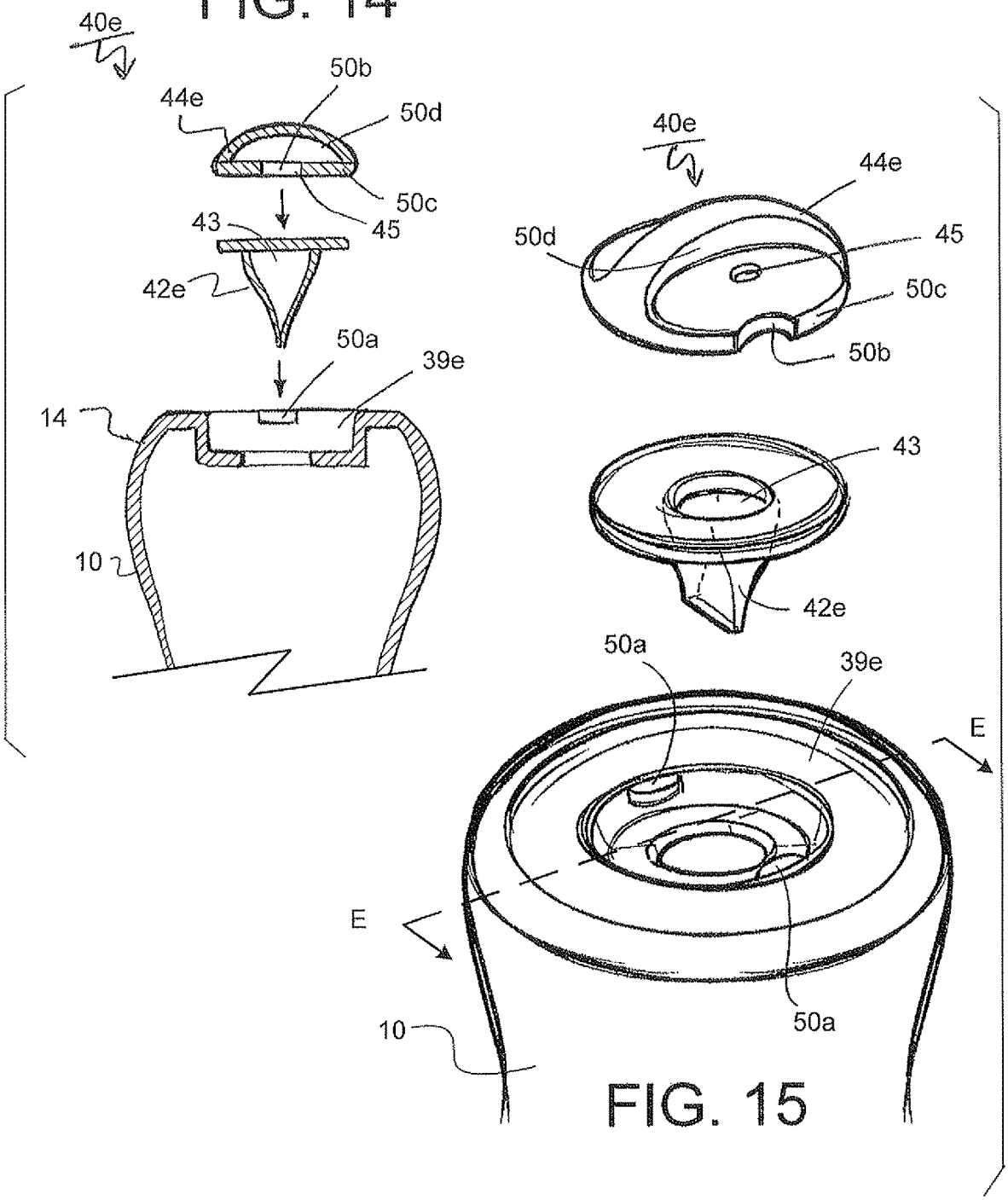
FIGS. 14 and 15 show exploded views of a fifth valve configuration for the container system, FIG. 14 being a cross section view about E-E in FIG. 14.

FIGS. 14 and 15 show exploded views of a fifth vent valve 40*e* configuration for the expandable container system 100. The vent valve 40*e* includes a resilient member 42*e* and cap 44*e*. At least one passage 43 is provided in the resilient member 42*e* to allow the flow of a first fluid (F1). A second passage 45 is provided in the cap 44*e* to also moderate and allow the flow of the first fluid (F1). The first passage 43 and the second passage 45 cooperate to efficiently allow the passage of a predetermined amount of the first fluid (F1) through the vent valve 40*e*.

In a closed position, the resilient member 42*e* is constructed in a duck bill configuration and made of a resilient sealing material adapted to provide a leak proof seal between the container 10 and the cap 44*e*. The resilient member 42*e* is disposed between the cap 44*e* the lower end 14 of the container 10. The cap 44*e* is disposed in a recess 39*e* provided in the lower end 14 of the container 10. The vent valve 40*e* is secured into the recess 39*d* utilizing a pair of locking protrusions 50*a*.

The vent valve 40*e* includes a flange 50*c* and a cut-out portion 50*b* mating with the shape of the locking protrusions 50*a*. In use, the vent valve 40*e* and the resilient member 42*e* are aligned inside of the recess 39*d*, and the cut-out portion 50*b* on the flange 50*c* is aligned with the mating shape of the locking protrusions 50*a*. The upper surface of the flange 50*c* is depressed below the lower surface of the locking protrusions 50*a* and twisted by the knob 50*d* so that the cut-out portion 50*b* and the locking protrusions 50*a* are no longer aligned and prevented from being withdrawn. The flange 50*c* is then locked in the recess 39*e* disposed in the end 14 of the container 10 by the upper surface of the flange 50*c* bearing against the lower surface of the locking protrusions 50*a*.

Figure 16:
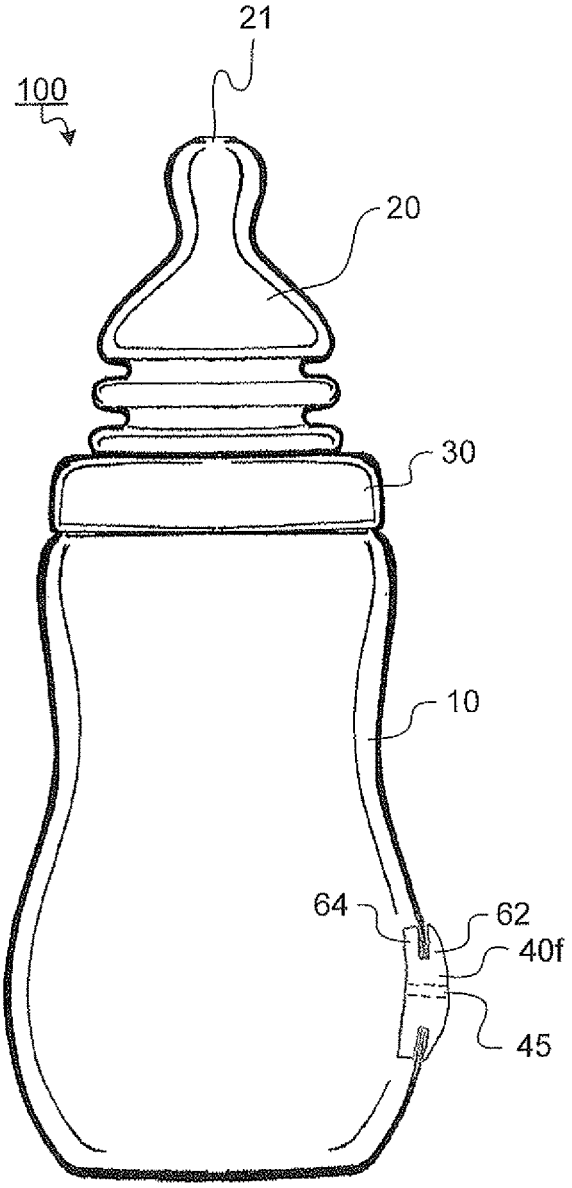
FIGS. 16 and 17 show exploded views of a sixth valve configuration for the container system.
Figure 17:
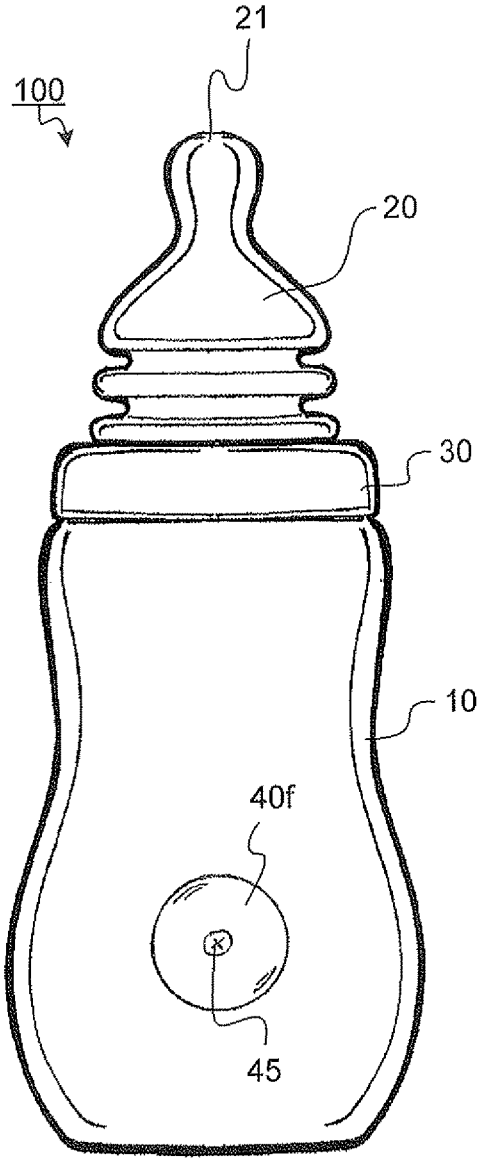
Figure 18:
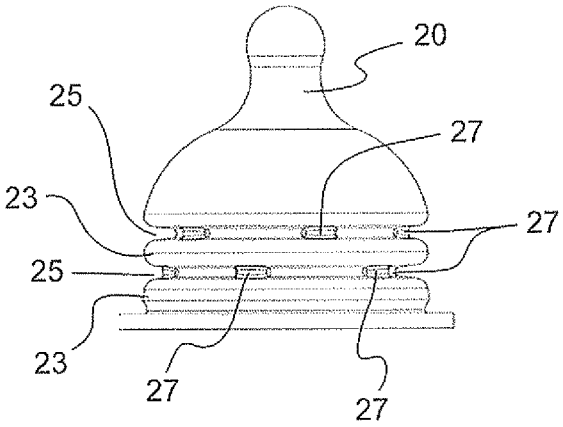
FIGS. 18, 19 and 20 illustrate various views of an expandable nipple configuration including nubs for the container system.

FIGS. 16 and 17 illustrate an exemplary sixth one-way vent valve 40*f* configuration for the expandable container system 100 utilizing the resilient member 40*f* without a cap. As shown, the resilient member 40*f* is a one-way valve provided in a side wall of the container 10. The vent valve 40*f* is a resilient member 64 having an outward flange 62 disposed outside of the container 10, and an inward flange 64 disposed inside of the container 10. The vent valve 40*f* includes a passage 45 in the one-way vent valve 40*f* to efficiently moderate the flow of the fluid into the container 10.

The size, shape, orientation of the one way vent valve 40*f* may take a variety of different shapes in order to efficiently modulate the fluid flow rate across the vent valve 40*f*. The vent valve 40*f* is constructed of a resilient sealing material adapted to provide a leak proof seal between the container 10 and the outside atmosphere. The vent valve 40*f* may be co-molded into the side wall of the container 10. Although shown as protruding outside of the wall of the container 10, the vent valve 40*f* may be recessed in a variety of different ways as described and shown with respect to the various embodiments provided herein.

It is to be understood that the size, shape, orientation of the valve, its component parts, valve passages and various other features may be modified in accordance with the subject disclosure to efficiently modulate the fluid flow rate through the valves and its various components parts.

As briefly described above, FIGS. 18, 19 and 20 depict various views for another exemplary expandable nipple 20*a* configuration for the container system. The expandable nipple 20*a* includes various nubs 27 disposed in the interstitial gaps 25 between the various pleats 23. The nubs 27 act to restrict the direction in which the expandable nipple 20*a* is permitted to bend. If the expandable nipple 20*a* is bent toward a nub 27, the nub 27 will reduce the amount of bend or compression that the pleat 23 can make in that particular direction. However, if the expandable nipple 20*a* is bent in a direction where no, or a limited number of nubs 27 are provided then the expandable nipple 20*a* will be permitted to bend further in that particular direction with fewer nubs 27. The nubs 27 can be positioned in any predetermined arrangement to direct or limit the amount of movement is a particular direction.

Various materials may be used according to this disclosure including, but not limited to: polypropylene, a thermoplastic elastomer, a high density polyethylene, polycarbonate, urethane rubber, silicone and/or any other suitable material may be used.

Figure 24:
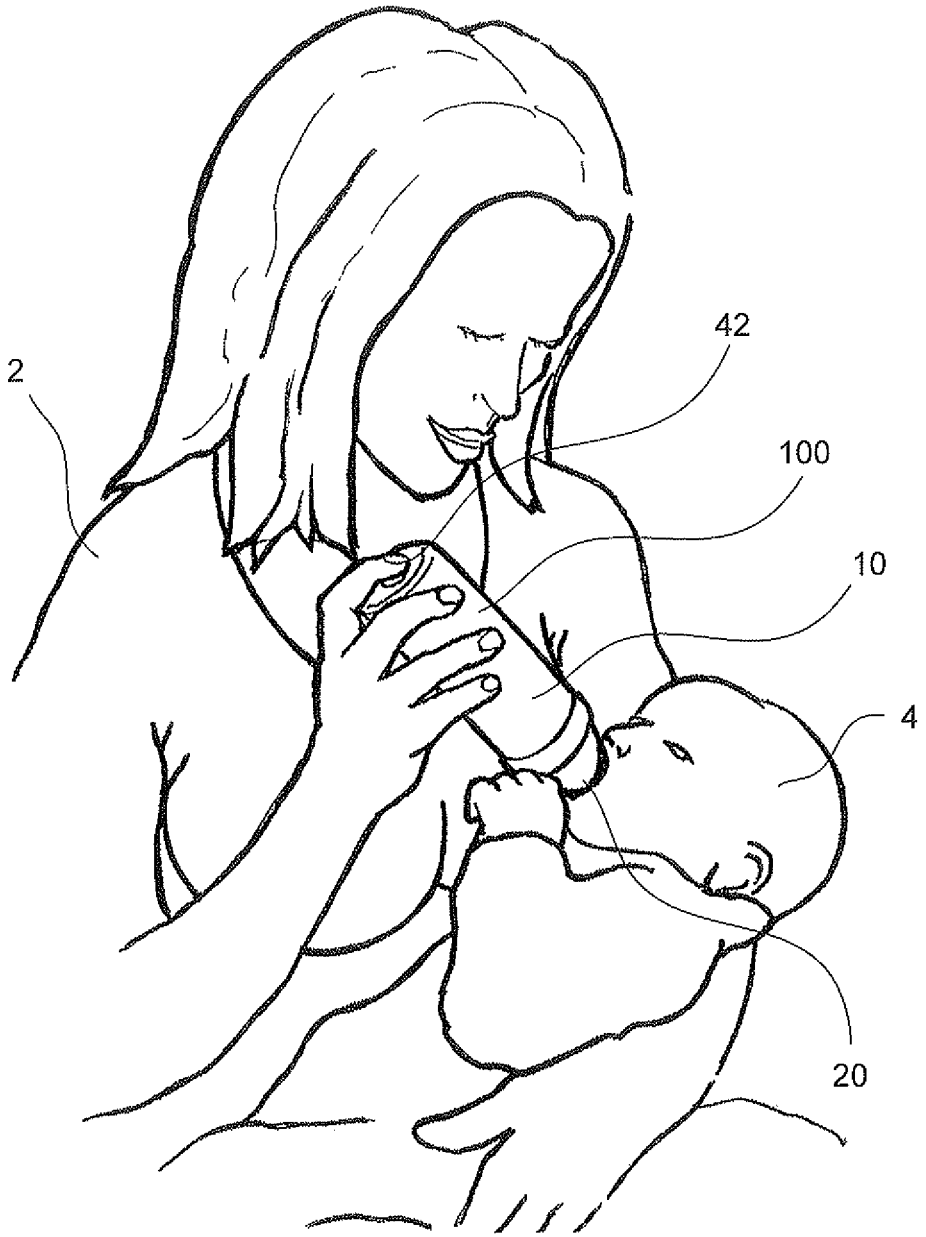
FIG. 24 shows an infant being fed by a caregiver with the container system.
Figure 27:
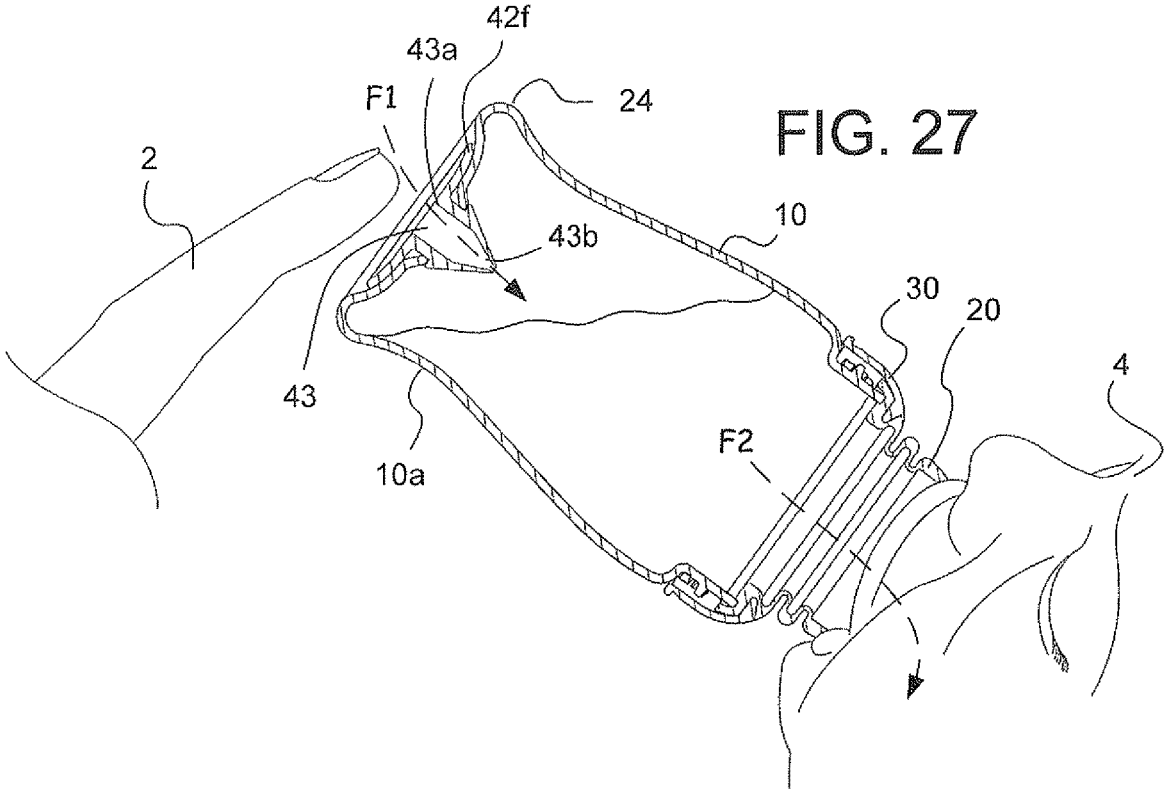
FIGS. 27-29 demonstrate an infant being fed by the container system as the resilient member is manipulated by the caregiver.
Figure 28:
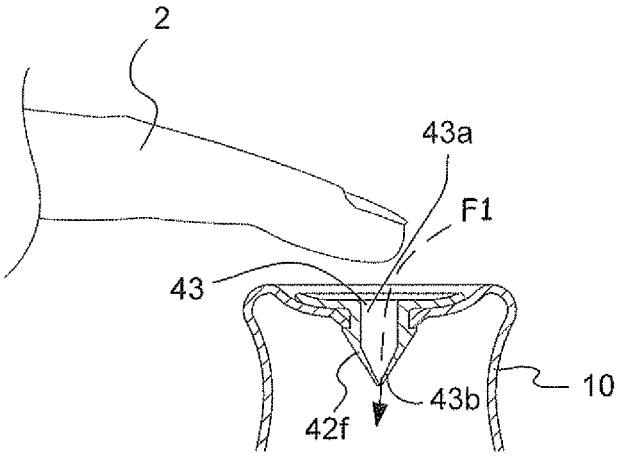

It is to be understood that the resilient member 42 is removable and adapted to allow a first fluid (F1) (such as air) to vent into the container 10 when a vacuum is generated within the container 10. Furthermore, the resilient member 42 in the container system 100 is constructed to permit a user to manually modify the rate of a first fluid (F1) which directly affects the flow of the second fluid (F2) (as shown in FIGS. 24 and 27-28 and discussed later) coming out of the container 10. That is, the fluid flowing out of the expandable container system 100 can be controlled by selectively covering the first passage 43 of an inlet opening in the resilient member 42.

Although the expandable container system 100 is illustrated for use as a baby bottle, it is to be understood that the container system and valve 40 may be used for a variety of different containers and applications, such as for example: house-wares: such as condiments, cleaning solutions, cooking ingredients; hardware: such as lubricants, stain removers, pesticides, lawn care; commercial applications: such as condiments in restaurants or the like, and/or any other contained product suitable for use with the expandable container system 100.

FIG. 24 demonstrates a caregiver 2 feeding an infant 4 with the expandable container system 100, such as in a baby bottle as shown integrated with an exemplary removable one-way resilient member 42. By selectively manipulating the opening passage 43 of the resilient member 42, the one-way resilient member 42 can control the flow of the first fluid (F1), which affects the fluid flow of the second fluid (F2, such as formula in an infant bottle) out of the expandable container system 100.

Figure 25:
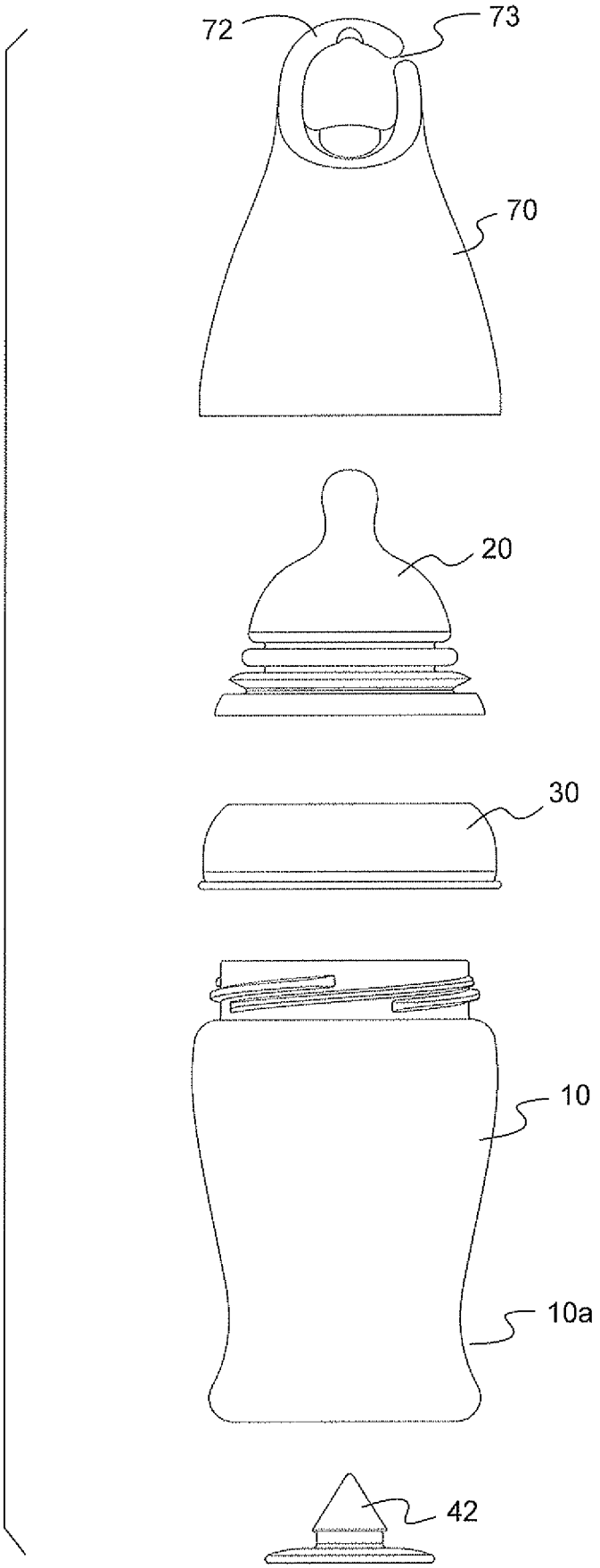
FIG. 25 illustrates an exploded view of another configuration for the container system.
Figure 26:
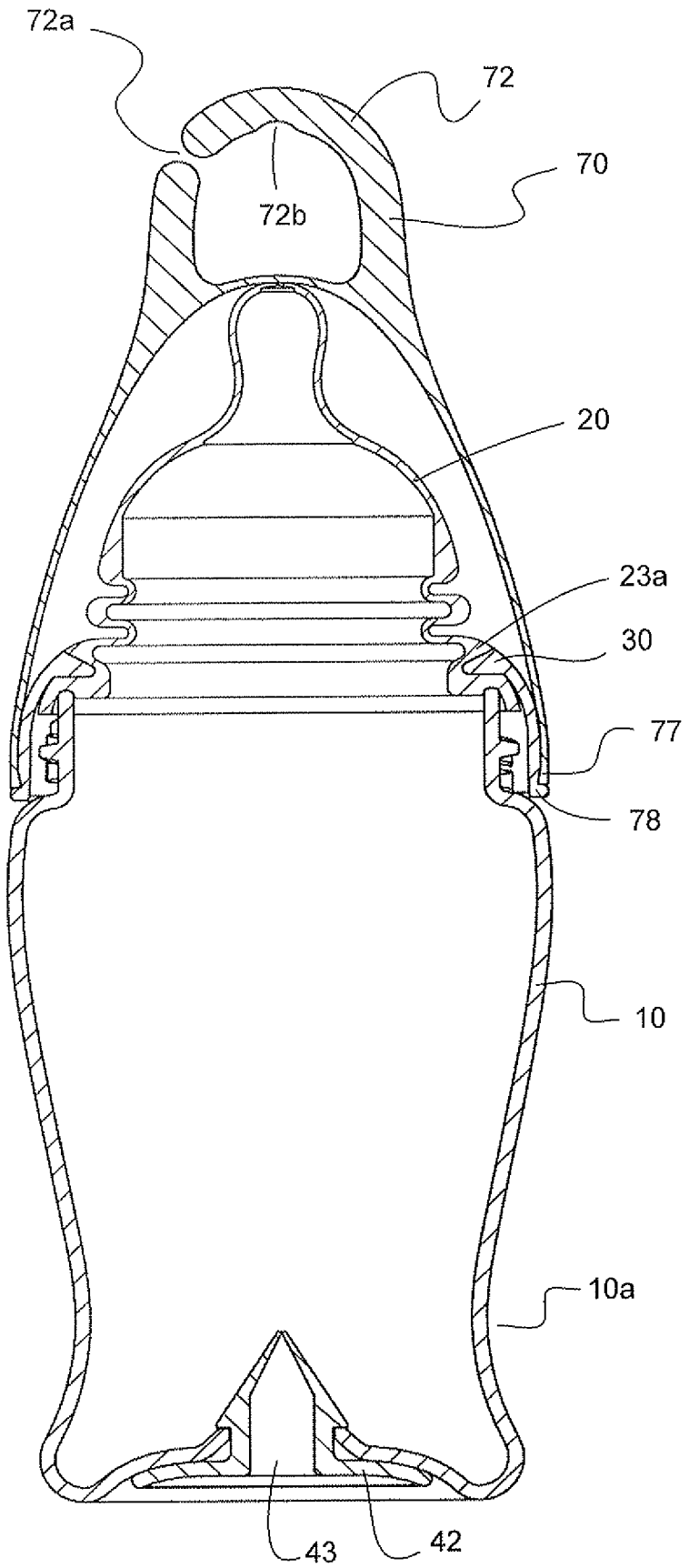
FIG. 26 depicts a cross section view of the container system.

FIGS. 25-26 show another exemplary configuration for the expandable container system 100. The expandable container system 100 includes a cover 70, an expandable nipple 20, a collar 30, a container 10 and a resilient member 42. For exemplary purposes, the resilient member 42*f* is provided. According to this embodiment, a retaining cap is not provided and the leak proof seal and flow of the first fluid (F1) through the first passage 43 in the resilient member 42*f* and into the bottle 10 is controlled by the configuration of the resilient member 42*f*.

Figure 29:
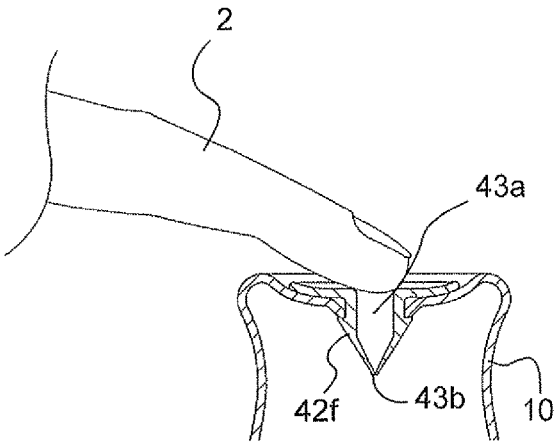
Figure 30:
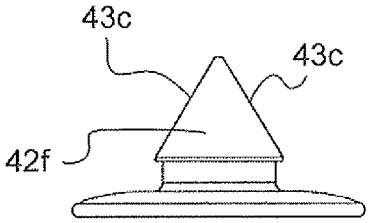
FIGS. 30-33 show front, side, cross section and top views of an exemplary resilient member.
Figure 31:
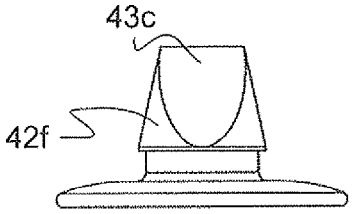
Figure 32:
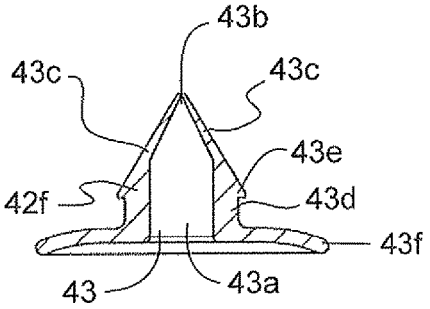
Figure 33:
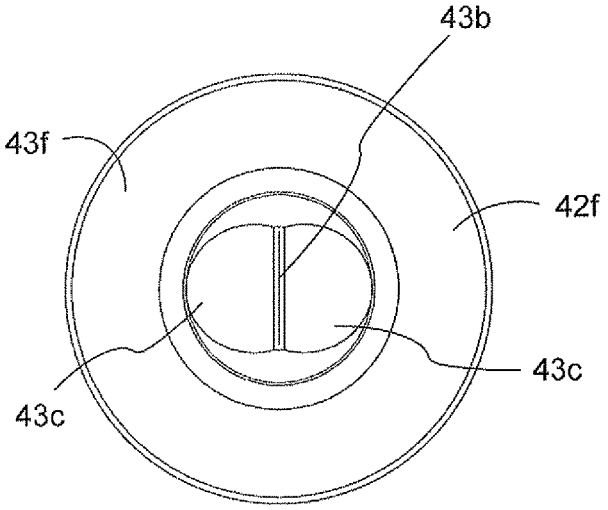

As shown in operation in FIGS. 27-29, the one-way removable resilient member 42*f* disposed in the lower end 24 of the container 10 may be manually manipulated by a finger of a caregiver 2 by covering and uncovering the inlet first passage 43 in order to regulate the flow rate of the first fluid (F1) into, and across the resilient member 42*f*. By manually manipulating the passage 43 in the one-way resilient member 42*f*, the flow of the second fluid (F2) out of the orifice in the nipple 20 can be controlled. That is, by controlling the flow of the first fluid (F1, such as air) into the container 10, the caregiver is able to reduce the amount of air intake and reduce the aeration in the container 10 by allowing air to come in from the bottom of the container 10. Likewise, by manipulating the increase or decrease of the flow rate of a first fluid (F1) into the resilient member 42*f*, the flow rate of a second fluid (F2) out of the container 10 and into the infant's mouth can be conveniently increased or decreased.

The first passage 43 in the resilient member 42*f* may be selectively closed off as shown in FIGS. 28-29 at an inlet end 43*a* of the resilient member 42*f* to slow down the flow of the first fluid (F1) flowing across the resilient member 42*f* and into the container 10. Alternatively, the inlet end 43*a* of the resilient member 42*f* may be selectively manipulated to modify the rate of flow of the first fluid (F1) into the container 10, which in turn controls the rate of flow of the second fluid (F2) out of the container 10 and into the mouth of the infant.

As shown, the expandable container system 100 is embodied as an infant bottle having a narrowed neck 10*a* portion closer to the lower end of the container 10. The benefit of providing the narrowed neck 10*a* portion enables a caregiver to more securely and comfortably hold the container 10 from the lower end of the container 10 while allowing the caregiver's finger to lie close and conveniently adjacent to the inlet passage 43 of the resilient member 42*f*. As such, the caregiver is able to conveniently control the opening and closing of the passage 43 in the expandable container system 100.

It is also to be understood that resilient member 42 may be used in a container without the use of an expandable outlet device (such as the expandable nipple 20 described in this subject disclosure). In such a system, a non-extendable nipple may be used and the user may still selectively control the flow rate of a second fluid (F2) coming out of the container 10 by selectively covering and uncovering the passage of the resilient member. Likewise, the nipple can be replaced by some other type of dispenser or dispensing element for a different product capable of integrating the one-way valve which can be manually manipulated by a user selectively covering and uncovering the inlet 43 passage of the resilient member 42 disposed in the lower end, or other wall of the container 10.

It is to be understood that the valving mechanism may be disposed at various locations on the bottle container. For example, the valve may be located in the collar, on a dispensing element, in the container near the top of the container, the side or at the bottom of the container. According to this subject disclosure, the inlet may be manipulated at any location by the hand of a user, and more particularly by a finger of a user.

Referring back to FIG. 27, the expandable infant bottle includes an expandable nipple 20 fastened to the container 10 by a collar 30. The expandable nipple 20 includes an outlet 21 from which the second fluid (F2) held in the container 10 will flow as the infant sucks from the expandable nipple 20. As shown in this embodiment, the resilient member 42*f* is provided in the lower end 24 of the container 10 and easily accessible by the finger of the caregiver 2.

FIGS. 28-29 illustrate various operations of the resilient member 42*f*. In FIGS. 27-28, the first passage 43 of the resilient member 42*f* is shown unblocked and open. In this position, the resilient member 42*f* operates as an air vent to permit a predetermined amount of a first fluid (F1, such as air) to enter into the container 10 through the first passage 43 of the resilient member 42*f* under a vacuum as the second fluid (F2) from within the container 20 is drawn out from an opposite end in the container 10. Entry of the atmospheric air drawn into the first passage 43 of the resilient member 42*f* occurs when a vacuum is built up inside of the container 10. The vacuum draws air from the surrounding atmosphere disposed outside of the container 10. In the case where the container 10 is a baby bottle (such as shown in FIG. 27), being able to automatically regulate the vacuum built up in the container 10 across the first passage 43 of the resilient member 42*f* has various advantages to nursing an infant as mentioned previously.

As shown in FIG. 29, the first passage 43 of the resilient member 42*f* is accessible by a caregiver 2 from outside of the container 10. In use, a tip of a finger of the caregiver 2 can be placed over the inlet passage 43*a* of the resilient member 42*f* in order to close off the flow of first fluid (F1) into the resilient member 42*f*.

In this closed position, the finger of the caregiver 2 blocks off the first passage 43 of the resilient member 42*f* so that the first fluid (F1, i.e. atmospheric air) may not enter through the first passage 43 of the resilient member 42*f* and into the container 10. In this way, the user may manipulate the flow of the second fluid (F2) out of the orifice 21 in the nipple 20 by selectively blocking the first passage 43 of the resilient member 42*f*. By blocking the first passage 43 of the resilient member 42*f*, as the second fluid (F2) is drawn through the orifice 21 outlet in the nipple 20, a vacuum is created in the container 10 as a result of the displacement of the second fluid (F2) in the container 20 since the atmospheric air is not allowed to enter through the first passage 43 of the resilient member 42*f* and into the container 10 to restore the displacement of the second fluid (F2) escaping from the container 10.

As the vacuum increases in the container 10, the continuous drawing of the fluid from inside of the container 10 becomes more difficult to suck out of the orifice 21 in the nipple 20 because of the build-up of the negative pressure vacuum inside of the container 10.

The caregiver 2 can selectively manipulate the flow of the second fluid (F2) coming out of the container 10 by intermittently blocking and unblocking the first passage 43 of the resilient member 42*f* with her finger as shown in FIGS. 28-29. Manual manipulation of the flow of second fluid (F2) dispensed from the container 10 is controlled by throttling the flow of first fluid (F1) into the passage 43 of the resilient member 42*f*, such as by intermittently blocking and unblocking the first passage 43 of the resilient member 42*f* with their finger.

FIGS. 30-33 show various views of the resilient member 42*f* configuration for the expandable container system 100. As shown in cross section in FIG. 32, the resilient member 42*f* includes a passage 43 having a first inlet passage 43*a* and an outlet passage 43*b*. The outlet passage 43*b* is configured in a duck bill configuration having two lips 43*c* butting up adjacent to each other at one end that open and close in response to a pressure differential inside and outside of the container system 100 to allow the fluid to pass through into the container 10.

As shown, the resilient member 42*f* includes a narrow neck portion 43*d* bordered by an upper shoulder portion 43*e* defining a lower end of the lips and a lower shoulder portion 43*f* that extends into a larger flange that fits within a recess 39*d* in the lower end of the container 10, as shown in FIGS. 28-29. The recess 39*d* is adapted to receive the resilient member 42*f*. Secured within the recess 39*d*, the resilient member 42*f* provides a leak proof seal preventing the leakage of fluid inside and outside of the container 10. Various configurations for the resilient member 42 are possible.

Figure 34:
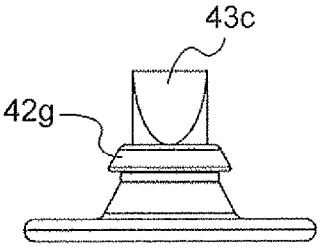
FIGS. 34-35 illustrate a front and cross section view of another exemplary resilient member.
Figure 35:
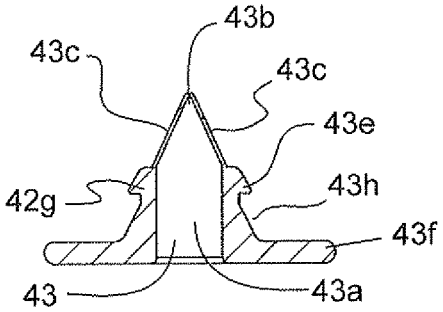
Figure 36:
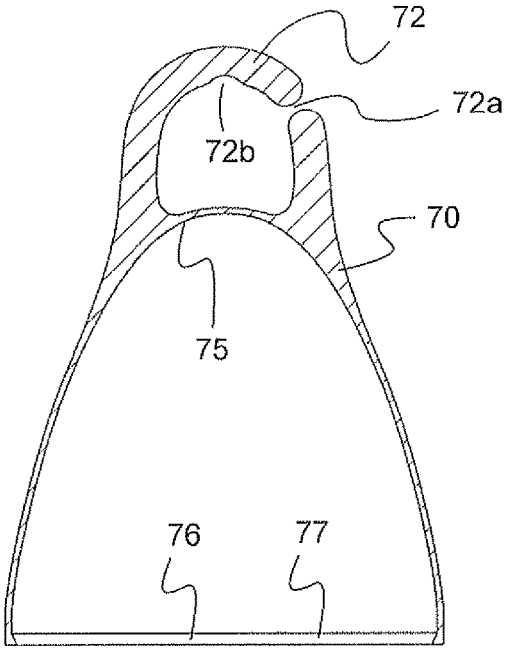
FIGS. 36-37 show a cross section and perspective view of the cover of the container system.

FIGS. 34-35 illustrate yet another resilient member 42*g* configuration for use in the expandable container system 100. As shown in cross section in FIG. 35, the resilient member 42*g* includes a passage 43 including a first inlet passage 43*a* and an outlet passage 43*b*. The outlet passage 43*b* is configured in a duck bill configuration also having a pair of lips 43*c* that open and close in response to a pressure differential inside and outside of the container system 100 as mentioned previously.

As shown, the resilient member 42*g* includes a flared narrow neck portion 43*h* bordered by an upper shoulder portion 43*e* defining a lower end of the lips and a lower shoulder portion 43*f* that extends into a larger flange that fits within a recess 39*d* in the lower end of the container 10. The recess 39*d* is adapted to receive the resilient member 42*g*. Secured within the recess 39*d*, the resilient member 42*g* provides a leak proof seal preventing the leakage of fluid inside and outside of the container 10.

FIGS. 36-37 and 25-26 show the container system 100 including a cover 70. The cover 70 is adapted to be releasably secured over the container 10. More specifically, the cover 70 is secured to the container system 100 to cover and protect the expandable nipple 20 from contamination.

Figure 38:
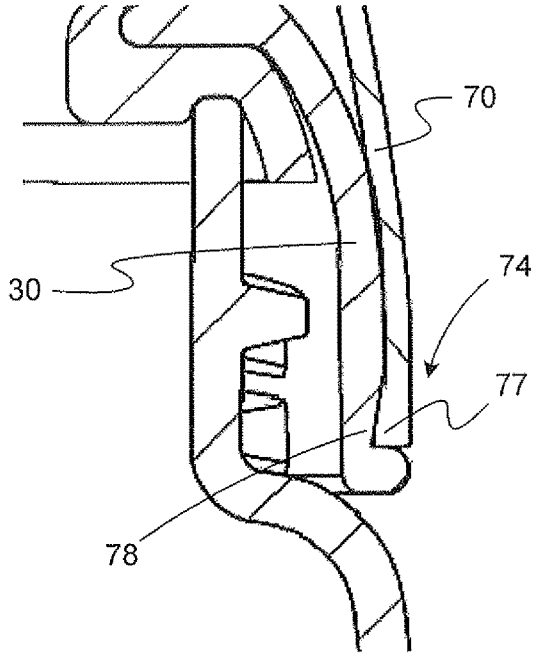
FIG. 38 depicts an exploded view of the connection for the fastener system at the cover and collar.
Figure 37:
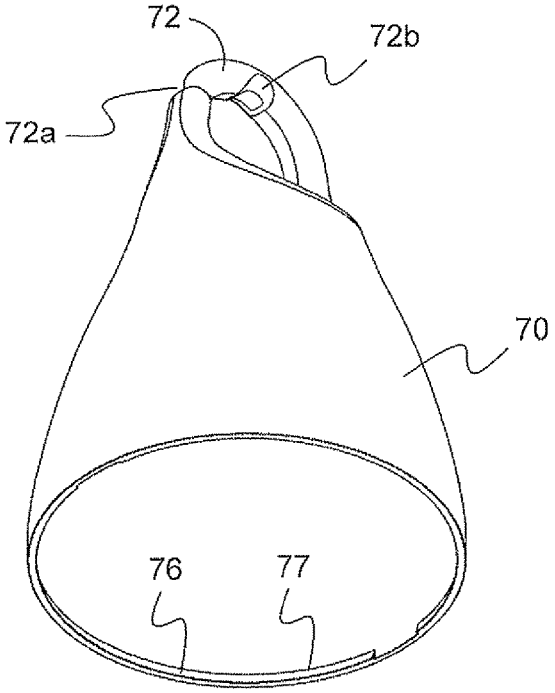
Figure 39:
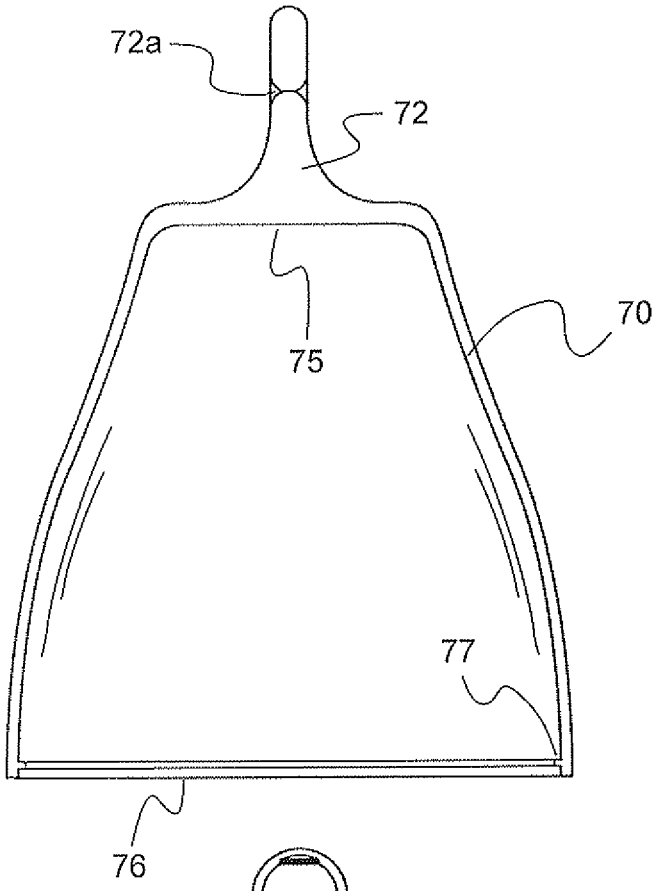
FIGS. 39-40 illustrate a view of another exemplary attachment connection mechanism for the cover onto the collar.
Figure 40:
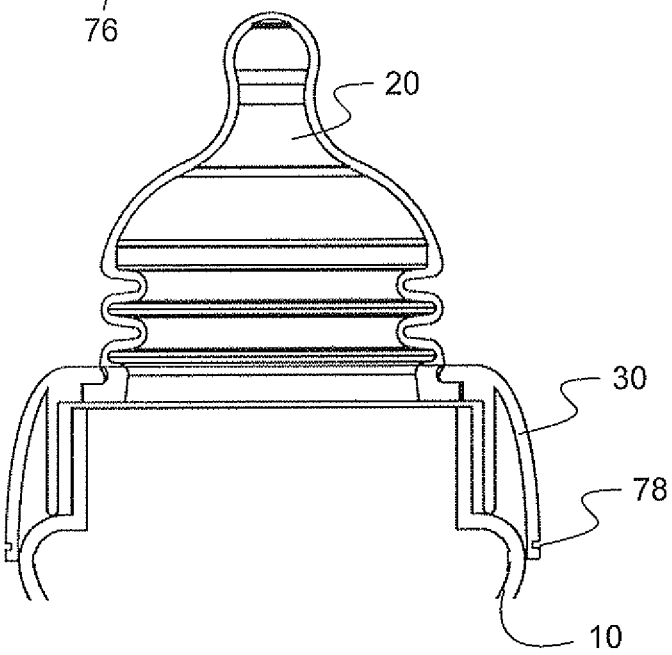

The cover 70 may be attached to the container 10 in a variety of ways. For example, and as shown in FIG. 38-40, the cover 70 may be secured by a friction fit to the container 10 over the collar 30 such that an internal diameter of the lower end 76 of the cover 70 is slightly smaller than the outer diameter of the collar 30. When the cover 70 is placed over the collar 30 and pressed thereon, a friction fit is formed between the two components. It is to be understood, that the cover 70 may be attached to various other components of the container 10.

As shown in FIGS. 25-26 and 36-37, the cover 70 includes a fastener 72 provided to attach the cover 70 of the container system 100 to an object via an attachment mechanism 74. The fastener 72 shown is constructed as a looped attachment member including an opening 72*a* to allow the fastener 72 to be opened or accessed and secured to the object. The fastener 72 may include various contours within the looped fastener, such as the slight recess 72*b* in the looped portion of the fastener 72 adapted to securely align the cover 70 onto a peg or the like, such as on a peg in a retail store. The fastener 72 integrated with the cover 70 may take a variety of different forms, including but not limited to, a hook, a belt loop, a strap and buckle, Velcro® attachment, a zipper and/or any other type of suitable fastener in accordance with the subject disclosure.

FIGS. 36-40 illustrate an enlarged view of the releasable cover 70 and an exemplary attachment mechanism 74 having complimentary parts disposed on the cover 70 and on the collar 30 respectively. In more detail, the cover 70 includes a closed end 75 and an open end 76. A first portion of the complimentary attachment mechanism 74 may include a projecting ledge 77 jutting inward from the inner surface of the cover 70. The projecting ledge 77 is disposed adjacent to the open end 76 of the cover 70.

A second portion of the complimentary attachment mechanism 74 disposed on the collar 30. The second portion of the complimentary attachment mechanism 74 may include a slight recess 78 in the collar 30 adapted to matingly receive the projecting ledge 77 in a secure manner.

When the cover 70 is attached to the collar 30 as shown in FIGS. 26 and 38, the projecting ledge 77 is aligned with and secured to the recess 78. The connection made between the projecting ledge 77 and the recess 78 is strong enough to overcome normal jostling of the container 10 filled with a fluid and attached to an object. For example, in the case of a baby bottle, when the fastener 72 is attached to a stroller, diaper bag, belt loop or the like, normal movement such as briskly walking with the stroller would not cause the cover 70 to be disengaged from the collar 30.

Although the attachment mechanism 74 is shown as a projecting ledge 77 and mating recess 78, it is to be understood that the attachment mechanism 74 can be any attachment mechanism capable of fastening the cover 70 to the collar 30. For example, the attachment mechanism 74 can be embodied as: a threaded fastener; a snap lock connection (such as shown in FIGS. 39-40) and/or any other type of attachment mechanism in accordance with the subject disclosure. Likewise, although the cover 70 is shown engaged with the collar 30, it is to be understood that the cover 70 may make a suitable secured connection with any other component on the container system 100 such as the body of the container 10.

FIGS. 39-40 depict a snap lock fastening mechanism 74. As before, a first portion of the complimentary attachment mechanism 74 may include a projecting ledge 77. The projecting ledge 77 may be disposed adjacent to the open end 76 of the cover 70 as shown in FIG. 39.

A second portion of the complimentary attachment mechanism 74 may be disposed on the collar 30. The second portion of the complimentary attachment mechanism 74 may include a slight recess 78 adapted to matingly receive the projecting ledge 77.

It is also to be understood that the cover 70 may be constructed and adapted for use as a feeding container. That is, a caregiver 2 can use the cover 70 as a feeding bowl by turning it upside down so that the open portion of the cover 70 faces substantially upward forming a lower closed end 75 bowl into which various edible items may be placed. A utensil, such as a spoon or fork may be used to scoop the edible contents from the lower closed end 75 of the cover 70 when used inverted as a bowl or similar container. In such a use, the fastener loop 72 may be conveniently used as a finger hole into which a caregiver, or the like, can secure the bowl in their hand by looping a finger through the loop 72 in the cover 70.

The cover may include various level measurement indicia (such as measurements in teaspoon, tablespoon, cup, liter or the like) so that when used as a bowl-like container, the caregiver can visually identify the quantity amount of an item disposed in the cover 70 when used as a bowl.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

The invention claimed is:

1. An expandable container system comprising:

a container;

an expandable accordion style nipple attached to a first end of the container and secured by a collar, the expandable accordion style nipple being configured to prime the flow of a first fluid from the container by increasing a first volume when stretching the expandable nipple from a compressed steady position via extended pleats or folds that increase interstitial spaces to a second greater volume that creates a vacuum in the container, wherein the expandable accordion style nipple is adapted to create a counteracting compression force when the stretching is released that biases to return the expandable nipple to the compressed steady position; and a removable valve attached to a second end of the container and having an outlet passage, wherein an inlet in the valve is selectively blocked and unblocked by a portion of a finger to control an entry of a second fluid into the container.

2. The expandable container system in claim 1, wherein the inlet in the valve is selectively blocked and unblocked to control a flow of a second fluid out of an outlet in the expandable nipple.

3. The expandable container system in claim 1, wherein when the inlet in the valve is blocked, a pressure in the container is reduced, and a flow rate of a second fluid out of an outlet of the expandable nipple is reduced.

4. The expandable container system in claim 1, wherein when the inlet in the valve is in an unblocked position, extending the expandable nipple generates a counteracting bias force within the container and the first fluid is drawn in through the valve, and wherein when the expandable nipple is released, the expandable nipple is biased back toward an unextended state, and an increase in pressure created by the counteracting bias force urges a second fluid to flow out of an outlet in the expandable nipple.

5. The expandable container system in claim 1, wherein the valve is placed on a surface of the container.

6. The expandable container system in claim 1, further comprising a cover with a fastener, wherein the cover has a first open end and a second closed end adjacent to the fastener.

7. The expandable container system in claim 6, wherein the fastener has a curved portion adapted to receive a user's finger so that when inverting the cover for use, the cover is a bowl.

8. The expandable container system in claim 6, wherein the cover is releasably fastened to a collar, the cover having a first locking element, and the collar having a second locking element adapted to mate with and form a secure attachment to the cover.

9. A container system comprising:

a container;

a dispensing element having an outlet attached by a fixed collar to a first end of the container, the outlet in the form of an expandable accordion style nipple configured to prime the flow of a first fluid from the dispensing element by increasing a first volume when stretching the expandable accordion style nipple from a compressed steady position via extended pleats or folds that increase interstitial spaces to a second greater volume that creates a vacuum in the container and create a counteracting compression force when the stretching is released that biases to return the expandable accordion style nipple to the compressed steady position; and a valve with a passage having an inlet attached to a second end of the container, wherein the inlet in the valve is selectively blocked and unblocked by a portion of a finger to control the entry of a second fluid into the container.

10. The container system in claim 9, wherein the selectively blocking and unblocking of the inlet in the valve selectively controls a flow of a second fluid out of an orifice in the outlet.

11. The container system in claim 10, wherein when the inlet in the valve is blocked, a pressure in the container s reduced, which in turn lowers a flow rate of the second fluid out of the orifice in the dispensing element.

12. An expandable container system comprising:

a container;

a collar attached to a first end of the container;

an expandable accordion style nipple attached by the collar to the first end of the container, the expandable accordion style nipple adapted to increase a first volume when stretching the expandable accordion style nipple from a compressed steady position via extended pleats or folds that increase interstitial spaces to a second greater volume that creates a vacuum in the container and create a counteracting compression force when the stretching is released that biases to return the expandable accordion style nipple to the compressed steady position; and a valve attached to a second end of the container and having an outlet passage, the outer passage extending the length of an upper edge formed by the intersection of two planar surfaces, wherein an inlet in the valve is selectively blocked and unblocked by a portion of a finger to control an entry of a first fluid into the container, which in turn selectively blocks and unblocks a second fluid out of an outlet orifice in the expandable nipple.

13. The expandable container system in claim 12, wherein when the inlet to the valve is blocked manually by a user, a pressure in the container is reduced, thereby decreasing a flow rate of the second fluid out of an orifice in the expandable nipple.

14. The expandable container system in claim 12, wherein the valve is a one-way valve comprising:

a passageway;

an inlet disposed at a first end of the passageway having a circular flange;

an outlet biased closed and disposed at a second end of the passageway; and a neck portion adapted to receive a peripheral edge of an aperture in the container, the neck portion having a first shoulder including a portion of the circular flange, and a second shoulder including a portion of the outlet.

15. The expandable container system in claim 12, wherein when the inlet is in an unblocked position, a counteracting bias force is generated within the container and the first fluid is drawn in through the valve by extending the expandable nipple so that when the expandable nipple is released, the expandable nipple is biased back and is unextending, and an increase in pressure created by the counteracting bias force urges the second fluid to flow out of the outlet orifice in the expandable nipple.

16. An expandable container system comprising:

a container;

an expandable volume nipple attached to a first end of the container, the expandable volume nipple having an accordion style with at least one tapered pleat and configured to increase a first volume when stretching the expandable nipple from a compressed steady position to a second greater volume that creates a vacuum in the container and to create a counteracting compression force when the stretching is released that biases to return the expandable nipple to the compressed steady position; and a removable one-way valve attached to a second end of the container and having an outlet passage that is blocked and unblocked by a portion of a finger, wherein when the expandable nipple is extended, a first fluid is drawn in through the valve and a counteracting bias force is generated by the expandable nipple, so that when the expandable nipple moves in an opposite direction and is unextending, an increase in pressure created by the counteracting bias force urges a second fluid to flow out of an outlet in the expandable nipple.

17. The expandable container system in claim 16, wherein the first fluid may also be drawn in by an infant or animal sucking on the expandable nipple drawing the second fluid out of the outlet in the expandable nipple.

18. An expandable container system comprising:

a container;

an expandable volume nipple attached to a first end of the container, the expandable volume nipple configured to increase a first volume when stretching the expandable volume nipple from a compressed steady position via extended pleats or folds that increase interstitial spaces to a second greater volume that creates a vacuum in the container and to create a counteracting compression force when the stretching is released that biases to return the expandable volume nipple to the compressed steady position; and a removable one-way valve attached to a second end of the container and having an outlet passage that is blocked and unblocked by a portion of a finger, the outlet passage extending the length of an upper edge formed by the intersection oft wo planar surfaces, wherein when the expandable nipple is extended, a first fluid is drawn through the valve, and wherein when the expandable nipple is moved in an opposite unextended direction, a pressure within the container is increased and urges a second fluid to flow out of an outlet in the expandable nipple.

19. The expandable container system in claim 18, wherein when an infant sucks onto the expandable nipple in an extended direction or an unextended direction causes the second fluid within the container to be urged out of the outlet in the expandable nipple.

20. The expandable container system in claim 18, wherein a sucking vacuum pressure caused by an infant sucking onto the expandable nipple further causes the second fluid within the container to be urged out of the outlet in the expandable nipple.

* * * * *